United States Patent [19]

Tengler et al.

[11] Patent Number: 4,985,000

[45] Date of Patent: Jan. 15, 1991

[54] SHIELDED CABLE TERMINATION ASSEMBLY

[75] Inventors: John N. Tengler; Roy A. Gobets, both of Chico, Calif.

[73] Assignee: Minnesota Mining and Manufacturing Co., Saint Paul, Minn.

[21] Appl. No.: 348,725

[22] PCT Filed: Sep. 29, 1987

[86] PCT No.: PCT/US87/02437

§ 371 Date: Mar. 28, 1989

§ 102(e) Date: Mar. 28, 1989

[87] PCT Pub. No.: WO88/02561

PCT Pub. Date: Apr. 7, 1988

Related U.S. Application Data

[63] Continuation-in-part of Ser. No. 913,723, Sep. 30, 1986, Pat. No. 4,786,257.

[51] Int. Cl.[5] ..... H01R 13/658

[52] U.S. Cl. ..... 439/497; 439/445

[58] Field of Search ..... 439/92, 95, 96, 98, 439/108, 445–448, 492–499, 607, 610

[56] References Cited

U.S. PATENT DOCUMENTS

| | | | |
|---|---|---|---|
| 3,496,520 | 2/1970 | Reynolds . | |
| 3,573,714 | 4/1971 | Turner | 439/445 |
| 3,605,060 | 9/1971 | Praeger et al. . | |
| 3,951,492 | 4/1976 | Braund . | |
| 4,029,914 | 6/1977 | Schmidt et al. . | |
| 4,030,799 | 6/1977 | Venaleck . | |
| 4,094,564 | 6/1978 | Cacolici . | |
| 4,105,278 | 8/1978 | Braund et al. . | |
| 4,157,612 | 6/1979 | Rainal . | |
| 4,225,207 | 9/1980 | Brandeau et al. . | |
| 4,310,208 | 1/1982 | Webster et al. . | |
| 4,367,909 | 1/1983 | Shatto, Jr. . | |
| 4,408,823 | 10/1983 | Huber . | |
| 4,420,201 | 12/1983 | Stephenson . | |
| 4,422,700 | 12/1983 | Krenz . | |
| 4,437,724 | 3/1984 | Volka . | |
| 4,451,099 | 5/1984 | Bricker, Jr. . | |
| 4,579,404 | 4/1986 | Lockard . | |
| 4,582,384 | 4/1986 | Frantz et al. . | |
| 4,588,239 | 5/1986 | Venaleck . | |
| 4,596,428 | 6/1986 | Tengler . | |
| 4,598,969 | 7/1986 | Stephenson . | |
| 4,602,830 | 7/1986 | Lockard | 439/108 |
| 4,602,831 | 7/1986 | Lockard . | |
| 4,605,276 | 8/1986 | Hasircoglu . | |
| 4,609,241 | 9/1986 | Peterson . | |
| 4,639,054 | 1/1987 | Kersbergen . | |
| 4,655,515 | 4/1987 | Hamsher, Jr. et al. . | |
| 4,682,828 | 7/1987 | Piper et al. . | |
| 4,786,257 | 11/1988 | Tengler . | |

*Primary Examiner*—Neil Abrams

*Attorney, Agent, or Firm*—Renner, Otto, Boisselle & Sklar

[57] ABSTRACT

A cable termination assembly comprises a shielded electrical cable or cables including plural wire conductors and an electrical shield or shields therefor, an electrical bus electrically connected to the cable shield or shields, a housing for supporting therein plural electrical contacts and the bus, a printed circuit board electrically connecting the contacts to the respective wire conductors, an electrical shield attached to and at least partly surrounding the housing, the housing including a wire management comb including plural slots for positioning at least some of the wire conductors in a predetermined arrangement for electrical connection to the printed circuit board and an electrically non-conductive body molded directly to the cable or cables, comb, bus and contacts to form a unified structure therewith, and the bus having a portion thereof extending externally of the molded body and electrically connected to the housing shield. Also disclosed is another cable termination assembly including a conductor-contact management comb for relatively positioning shielded twisted pair cables, a drain bus, a ground bus and contacts. The management comb includes access openings through which electrical connections between conductors, contacts and the ground bus are effected.

15 Claims, 10 Drawing Sheets

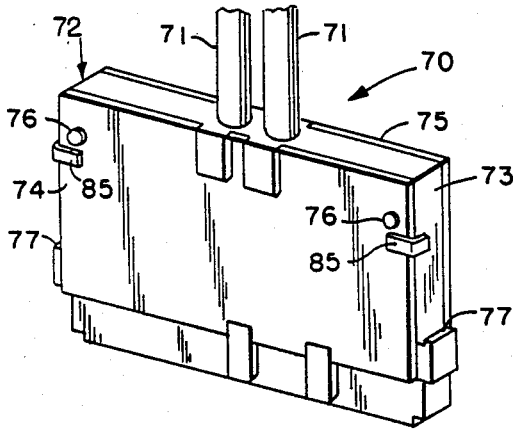
Fig. 9
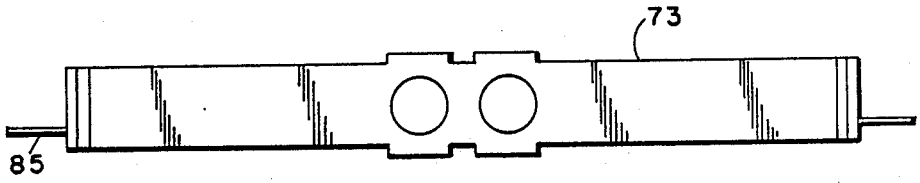
Fig. 11
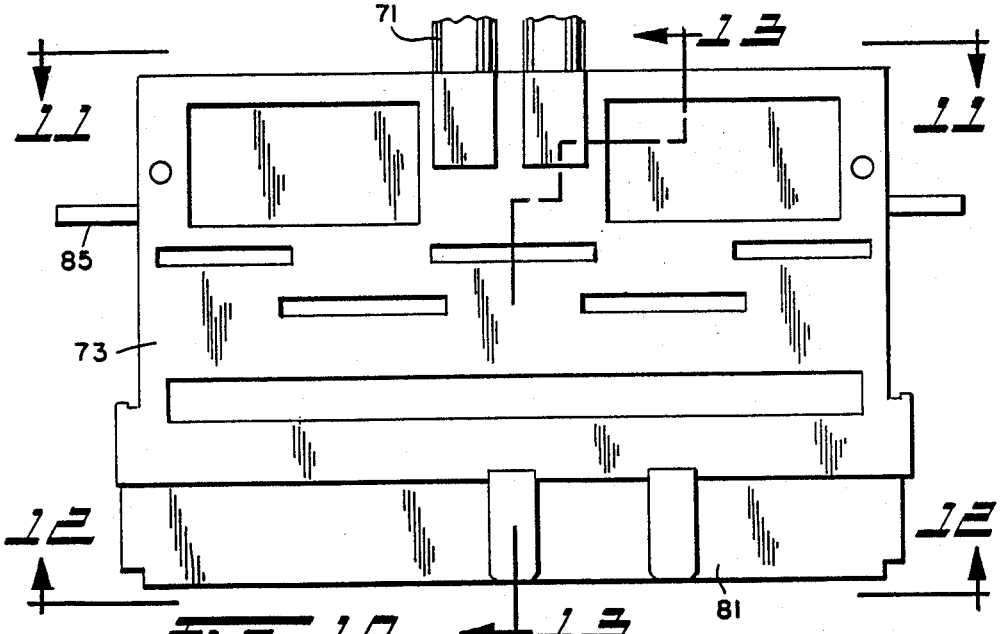
Fig. 10
Fig. 12
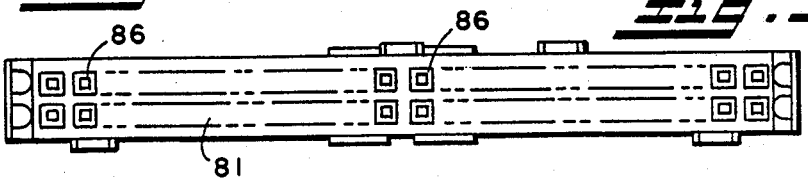

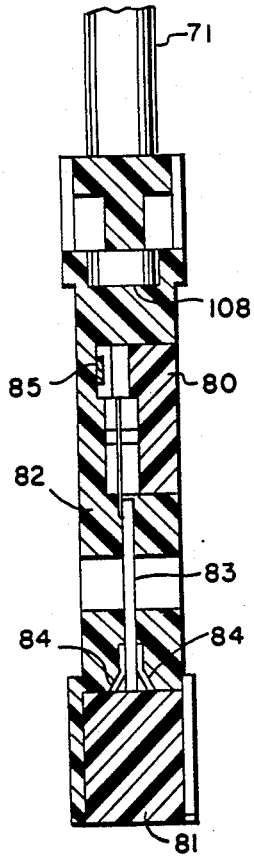
FIG. 13
FIG. 15
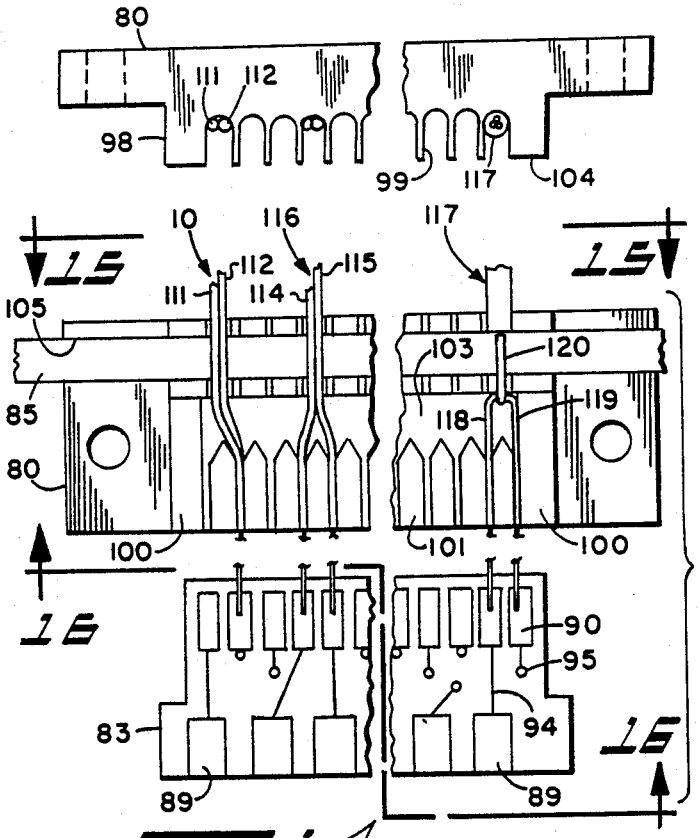
FIG. 14
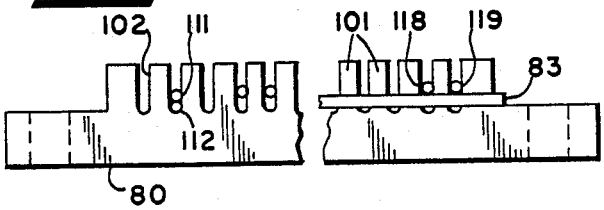
FIG. 16
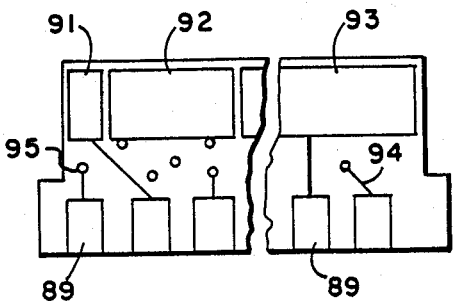
FIG. 17

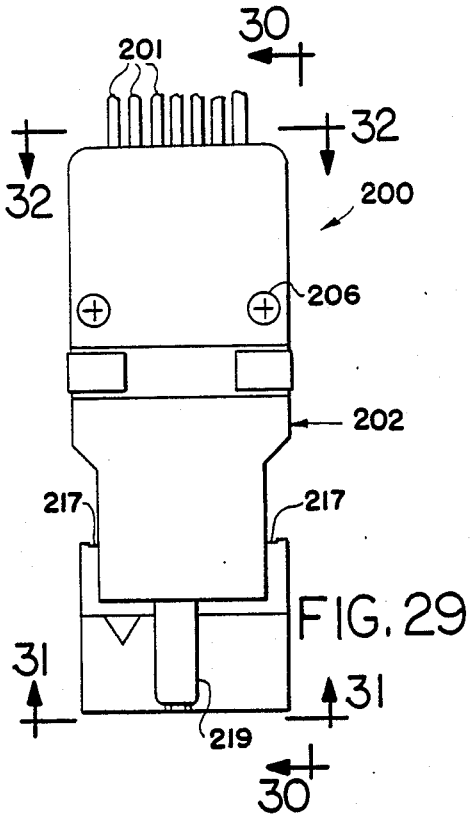
FIG. 29
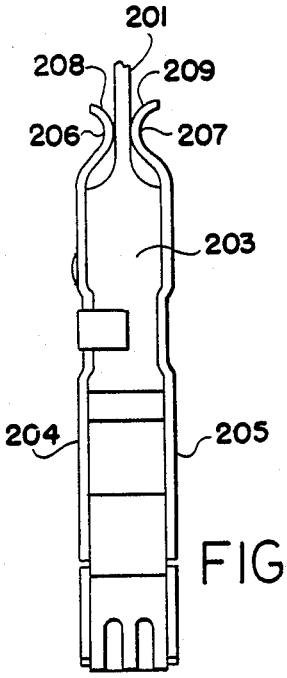
FIG. 30
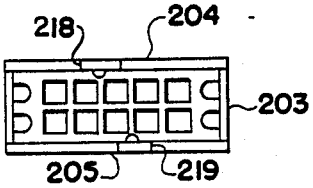
FIG. 31
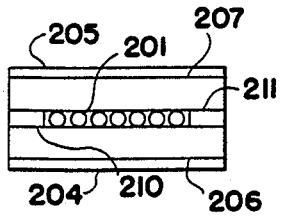
FIG. 32
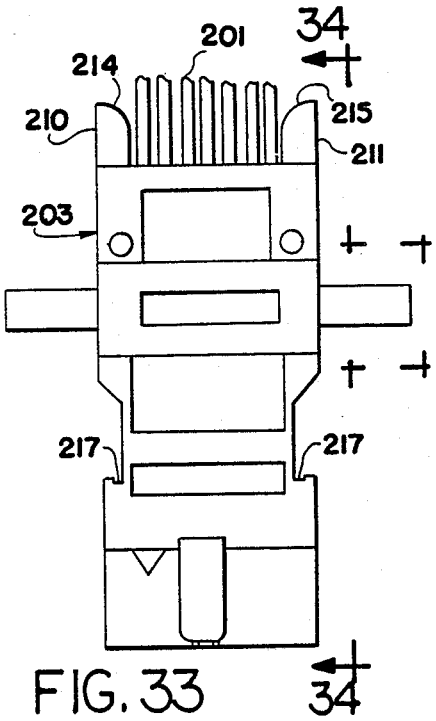
FIG. 33
FIG. 34
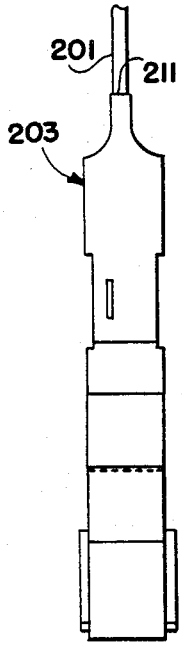

SHIELDED CABLE TERMINATION ASSEMBLY

RELATED APPLICATION DATA

This is a continuation-in-part of copending U.S Pat. application Ser. No. 913,723, filed Sep. 30, 1986 and entitled "Shielded Cable Termination Assembly", now U.S. Pat. No. 4,786,257 dated Nov. 22, 1988, which is hereby incorporated herein by reference.

FIELD OF THE INVENTION

The invention herein described relates generally to cable termination assemblies and, more particularly, to cable termination assemblies utilizing shielded electrical cables of various types.

BACKGROUND

In high speed computers, a complex mix of connectors and interconnections typically can be found. These include conventional wires, printed wiring, back panel wiring and interconnecting cables. Among the various types of interconnect cables that have been employed is twisted pair cable which includes a pair of insulated wires that are twisted together along their coextending lengths. The twisted pair along with a drain wire may be surrounded by a cable shield enclosed within an outer cable jacket or sheath to form what is herein referred to as discrete shielded twisted pair cable. It also has been common for multiple twisted pairs to be bundled together and surrounded by a common shield and jacket to form what is herein referred to as round shielded multiple twisted pair cable. This latter type of cable may include within the bundle one or more separately shielded twisted pairs including respective drain wires. Another conventional practice is to arrange the twisted pairs in side-by-side relationship and bond them to a suitable substrate to form what is herein referred to as twisted pair ribbon cable. Preferably the twists are interrupted every few feet and the wires laid parallel to facilitate termination. Also, such cable has been provided with a wraparound shield to minimize cable-to-cable crosstalk, to help protect the signals carried by the wires from other electromagnetic interference (EMI) sources and to reduce the amount of energy radiated from the cable. These functions also are performed by the shielding in the other above discussed types of twisted pair cable.

Along with the various types of interconnect cables, various types of cable terminations have been used to terminate the cables for connection to other electrical devices such as headers, pin fields and other electrical connectors. These cable terminations typically include electrical contacts that are electrically connected to respective conductors of the cable and supported in a housing in a desired pattern for connecting with another electrical device. The housing usually performs a strain relief function vis-a-vis the cable conductors and contacts, and together the housing, contacts and cable form what is herein referred to as a cable termination assembly.

Examples of prior cable termination assemblies for electrical cables having signal conductors and ground (isolation) conductors are disclosed in U.S. Pat. Nos. 4,094,564, 4,310,208, and 4,596,428. In the latter patent, a contact carrier has a crenellated surface which not only functions to separate the contacts but also to separate relatively adjacent signal conductors while displacing ground (isolation) conductors for soldered attachment to a ground bus. The contact carrier forms a part of the termination housing, and a strain relief body is molded about the carrier, contacts and conductors to form a unified structure therewith.

Generally, it is desired that a cable termination and/or cable termination assembly be constructed to minimize losses or irregularities in the signals being transmitted therethrough while also providing for detachable connection to other electrical equipment, such as to an electrical connector mounted to a printed circuit board. The construction of the cable termination and/or cable termination assembly must be concerned with electrical performance characteristics and the maintenance of these characteristics from device to device in a reliable manner. In this latter regard, it is important properly to maintain the relative positions of the individual components of the cable terminations and cable termination assemblies both during manufacture and during use. Other concerns include effective strain relief for the cables within and where they exit the termination, the minimization of the number of component parts required for assembly of the termination, and the provision of electrical connections of high integrity.

SUMMARY OF THE INVENTION

According to present invention, a cable termination assembly comprises shielded electrical cable means for transmitting electrical signals, the cable means including at least one wire conductor and an electrical shield therefor, an electrical bus, housing means for supporting therein at least one electrical contact electrically connected to the wire conductor, and electrical shield means attached to and at least partly surrounding the housing means, the housing means including electrically non-conductive body means for holding the cable means, bus and contact with respect to one another, and the bus having a portion thereof extending externally of the body means and electrically connected to the shield means. Preferably, the body means is molded directly to the cable means, bus and contact to form a unified structure therewith, and the portion of the bus extends from a wall of the molded body means.

According to another aspect of the invention, a cable termination assembly comprises cable means including a plurality of wire conductors, wire management means including plural slots for positioning at least some of the wire conductors in a predetermined arrangement, a plurality of electrical contact means for electrically connecting with external conductive elements when placed into engagement therewith, means for electrically connecting at least some of the contact means to respective wire conductors, and molded body means molded directly to the wire management means, cable means and contact means to form a unified structure therewith.

According to still another aspect of the invention, a cable termination assembly comprises shielded cable means including at least one wire conductor and an electrical shield therefor, and a shielded cable termination including a housing, at least one contact means supported in the housing and electrically connected to the wire conductor, shield means at least partly surrounding the housing, and means including a crimped clamp for electrically connecting the cable shield to the shield means. A crimp clamp according to the invention has use in other cable termination assemblies as well as in other types of electrical connectors.

Also provided by the invention is a universal wire management comb for cable termination assemblies including plural wire conductors electrically terminated at contacts supported in a housing. The wire management comb comprises a rear row of laterally spaced slots and a front row of laterally spaced slots of relatively narrower width spaced axially from the front row of slots to form a wire transition region therebetween. Wire management combs also are provided with recess means for locating and supporting a shield ground bus strip.

Further in accordance with the invention, there is provided a cable termination assembly comprising electrical cable means including plural electrical conductors, plural electrical contact members having forward contacting portions and rearward tail portions, conductor-contact management means for positioning the conductors and contact members with respect of one another, and housing means for holding the conductors, contact members and management means with respect to one another, the management means including on one side thereof a row of conductor positioning slot means to receive and position a plurality of the conductors in laterally spaced apart relationship and on an opposite side thereof a row of contact positioning slot means to receive, position and align the tail portions of the contact members with respective ones of the conductors, and the management means further including opening means mutually adjacent the conductor positioning slot means and the contact positioning slot means for permitting attachment of the conductors on the one side of the management means to the tail portions on the opposite side of the management means.

According to still another aspect of the invention, a cable termination assembly comprises conductor management means including first and second body sections each including at least one conductor slot opening to a top side of the housing, the first and second body sections being longitudinally spaced apart to form therebetween an opening, at least one conductive member coextensive with the opening and located generally beneath the one slot of each body section, and at least one conductor having a first portion received in the one slot of the first body section, a second portion received in the one slot of the second body portion, and a connection portion between the first and second portions which extends downwardly through the opening and is attached, preferably by welding, to the conductive member.

According to yet another aspect of the invention, a cable termination assembly comprises electrical cable means including plural wire conductors; plural electrical contact members having forward contacting portions and rearward tail portions, at least one of the tail portions having attached thereto a respective one of the conductors; an electrical bus located generally rearwardly of the tail portions of the contact members, the tail portions of at least two of the contact members being attached to the electrical bus and the electrical bus being spaced from the tail portion of at least one other of the contact members to which one of the conductors is attached; and housing means for holding the conductors, contact members and electrical bus with respect to one another.

The invention also provides a novel conductor management comb for use in a cable termination assembly, comprising a pair of generally parallel, longitudinally extending side walls, four generally parallel and generally coplanar body sections extending laterally between the side walls and each including a row of slot means for locating respective portions of longitudinally extending conductors, and respective openings between relatively adjacent pairs of the body sections.

Also provided by the invention is a cable termination assembly comprising a housing having a generally rectangular rear end face having two opposed shorter sides and two opposed longer sides, a plurality of cables exiting rearwardly from the housing in a row parallel to the longer sides of the end face, a first pair of opposed curved surface means extending along the shorter sides of the end face, respectively, for defining a minimum bending radius for the cables when flexed in a direction parallel to the longer sides, and a second pair of opposed curved surface means extending along the longer sides of the end face, respectively, for defining a minimum bending radius for the cables when flexed in a direction parallel to the shorter sides and for maintaining the cables between the curved surface means of the first pair. Preferably shield means attached to and at least partly surrounding the housing include generally planar and parallel shield portions at opposed sides of the housing, and the shield portions include bent rear end portions which extend rearwardly beyond the end face of the housing at the longer sides of the end face to provide the curved surface means of the second pair. Also, the housing preferably includes a pair of extensions extending rearwardly from the end face of the housing at the shorter sides of the end face to provide the opposed curved surfaces of the first pair. Each pair of opposed curved surface means may be used independently of one another, if desired.

The foregoing and other features of the invention are hereinafter fully described and particularly pointed out in the claims, the following description and annexed drawings setting forth in detail certain illustrative embodiments of the invention, these being indicative of but a few of the various ways in which the principles of the invention may be employed.

BRIEF DESCRIPTION OF THE DRAWINGS

In the annexed drawings,

FIG. 9 is a perspective view of another cable termination assembly according to the invention;

FIG. 10 is a side view of the cable termination assembly of FIG. 9 exclusive of and prior to attachment of shield plates shown in FIG. 9;

FIG. 11 is a rear end view of the cable termination assembly of FIG. 10 looking generally in the direction of the arrows 11—11 thereof;

FIG. 12 is a front end view of the cable termination assembly of FIG. 10 looking generally in the direction of the arrows 12—12 thereof;

FIG. 13 is a sectional view of the cable termination assembly of FIG. 10 taken substantially along the line 13—13 thereof;

FIG. 14 is a plan view of a subassembly employed in the cable termination assembly of FIG. 9, there being shown the top side of a printed circuit board;

FIG. 15 is an elevational view of the subassembly of FIG. 14 looking in the direction of the arrows 15—15 thereof;

FIG. 16 is an elevational view of the subassembly of FIG. 14 looking in the direction of the arrows 16—16 thereof;

FIG. 17 is a plan view of the bottom side of the printed circuit board of FIG. 14;

FIG. 29 is a side view of a modified cable termination assembly with shield plates in place according to the invention;

FIG. 30 is an edge side view of the modified cable termination assembly of FIG. 29 looking in the direction of the arrows 30—30 of FIG. 29;

FIG. 31 is a front end view of the modified cable termination assembly of FIG. 29 looking in the direction of the arrows 31—31 of FIG. 29;

FIG. 32 is a rear end view of the modified cable termination assembly of FIG. 29 looking in the direction of the arrows 32—32 of FIG. 29;

FIG. 33 is a side view of the modified cable termination assembly of FIG. 29 exclusive of and prior to attachment of the shield plates;

FIG. 34 is an edge side view of the modified cable termination assembly of FIG. 33 looking in the direction of the arrows 34—34 of FIG. 33;

DETAILED DESCRIPTION

Figure 1:
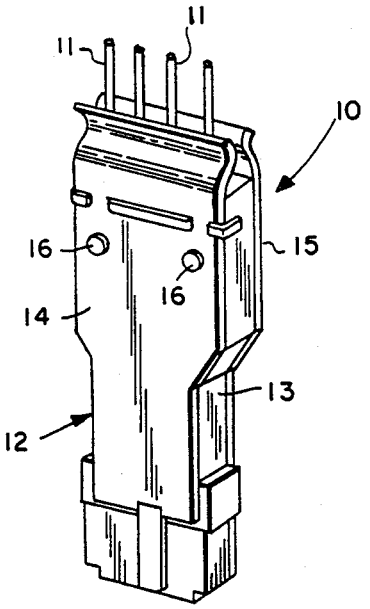
FIG. 1 is a perspective view of a cable termination assembly according to the invention.

Referring now in detail to the drawings, several preferred embodiments of the invention are shown. Although some and not all features of the invention are illustrated in any one embodiment thereof, it should be understood that any one feature may be employed independently or in combination with any other feature or features. For a complete understanding of the invention, the following detailed description is provided In FIG. 1, a cable termination assembly according to the invention is indicated generally at 10. The cable termination assembly 10 includes plural discrete cables 11 and a cable termination 12 for terminating the cables. The cable termination 12 includes a housing 13 and a pair of shield plates 14 and 15 secured to opposite sides of the housing 13 by rivets 16. The shield plates 14 and 15 extend beyond the rear (cable) end of the housing and are curved towards and then away from one another as shown to engage therebetween the cables 11 to provide strain relief in addition to that afforded by the housing 13. Although four discrete cables are shown, the number thereof may vary as desired for any given application and the discrete cables may be tied or otherwise joined together as desired.

With additional reference to FIGS. 2–5, the housing 13 is composed of a wire management comb 18, a front end cap 19 and a balance forming, strain relief body 20 molded directly to the comb 18 and front end cap 19 to form a unified structure therewith. The strain relief body 20 also is molded to and about at least parts of other components of the cable termination 12. These other components include a printed circuit board 21, electrical contacts 22 and a shield ground bus 23. The edges of the housing 13 are recessed to provide shoulders 26 which may be engaged in known manner by locking arms of a header to lock the cable termination to the header. The cable termination can mate, for example, with the header partially shown in broken lines at 24 in FIG. 4. The header 24 preferably is of shielded type having shield plates 25 extending above the header body for engaging and electrically connecting with respective shield plates 14 and 15 of the cable termination as shown.

Figure 3:
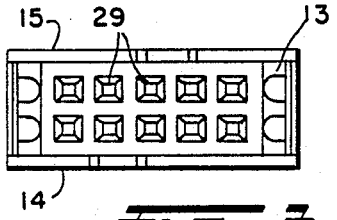
FIG. 3 is a front end view of the cable termination assembly looking in the direction of the arrows 3—3 of FIG. 2.

In the illustrated cable termination 12 which is of female type, the end cap 19 has in a front wall thereof a plurality of tapered access holes or openings 29 as seen in FIG. 3. The access holes 29 provide access to respective chambers or cells in the end cap in which respective contacting portions of the contacts 22 are accommodated within a measure of confinement. The chambers and contacting portions of the contacts are not shown in as much as the same may be of any suitable type. For example, the contacting portion of each contact may be of female fork type including a pair of tines for electrically connecting with a male contact such as a pin contact inserted therebetween via the respective access hole 29. For details of an exemplary female type contacting portion and related housing structure, reference may be had to U.S. Pat. No. 4,596,428. The number of contacts and associated access holes and chambers may be varied for any particular application as may their arrangement in the end cap. It also should be understood that the cable termination may be of other than female type such as of male type having outwardly protruding pin type contacting portions in which case the end cap may be eliminated or appropriately modified. More generally, the front end of the cable termination may be modified for any number of different applications.

Figure 4:
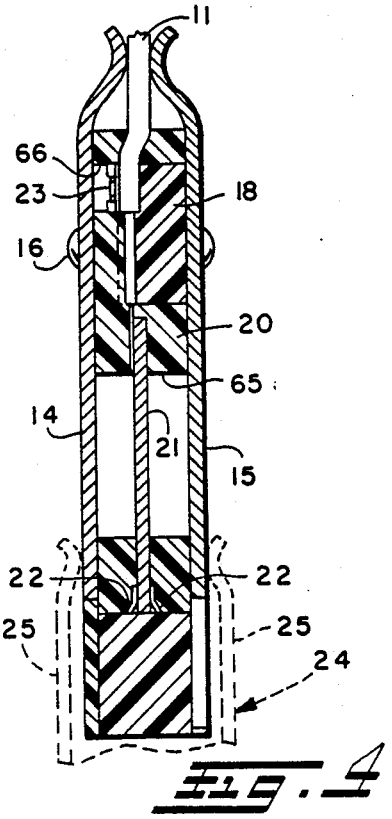
FIG. 4 is a sectional view of the cable termination assembly taken substantially along the line 4—4 of FIG. 2.

In addition to the female contacting portion, each contact 22 also has a rearwardly extending tail portion, this being the part of the contact shown in FIG. 4. The tail portions of the contacts are attached and electrically connected as by soldering to respective contact terminal pads 34 on the printed circuit board 21 best seen in FIGS. 5 and 6. In the illustrated cable termination 12 having contacts 22 arranged in a dual-in-line pattern, the tail portions of contacts in one row are soldered to contact pads on one side of the printed circuit board and those in the other row are soldered to contact pads on the other side of the printed circuit board. The contact terminal pads on each side of the printed circuit board may, as in the illustrated cable termination, be positioned directly opposite respective contact terminal pads on the other side to permit use of identical contacts of linear rather than offset type while still providing a dual-in-line pattern of contacts.

The contact terminal pads 34 on each side of the printed circuit board 21 are arranged along the forward edge of the board whereas other terminal pads 36 are arranged along the rear edge of the board for attachment thereto of conductors of the cables 11. Printed circuit traces 37 and plated through holes 38 electrically connect terminal pads at one end of the board to terminal pads at the other end of the board. For example, terminal pad **36*a* is connected to terminal pad 34*a* by printed circuit trace 37*a*. Further with respect to the illustrated printed circuit board, one side of the board has all of the conductor terminal pads 36 spaced along the rear edge thereof while the other side is provided with a ground bus pad 39 extending substantially the width of the printed circuit board. It should be understood that the interconnect pattern of conductive paths on and/or through the printed circuit board may be varied to provide for desired routing of electrical signals between conductors of the cables 11 and contacts 22**, and possibly other functions such as an impedance control, switching, signal modifying and even logic functions.

Figure 5:
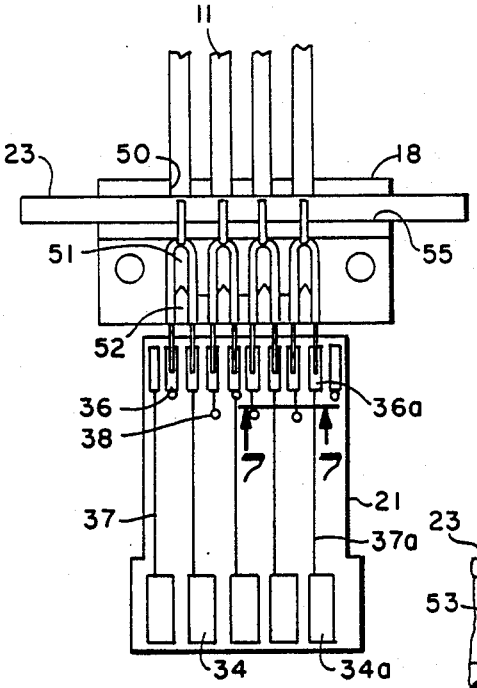
FIG. 5 is a plan view of a subassembly employed in the cable termination assembly of FIG. 1, there being shown the top side of a printed circuit board.
Figure 6:
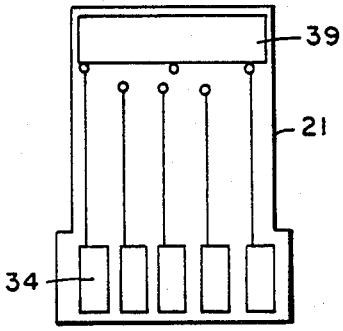
FIG. 6 is plan view of the bottom side of the printed circuit board of FIG. 5.
Figure 7:
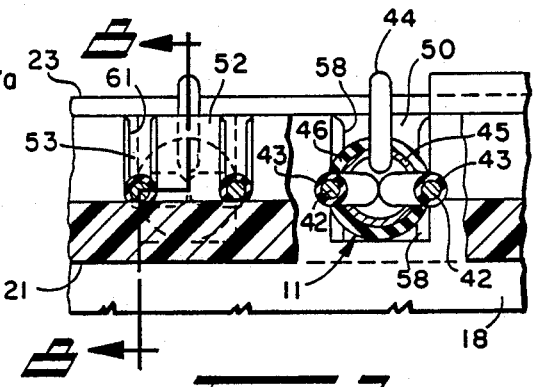
FIG. 7 is a partial sectional view of the subassembly of FIG. 5 taken substantially along the line 7—7 thereof.
Figure 8:
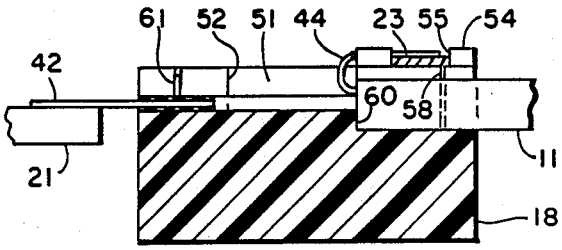
FIG. 8 is a partial sectional view of the subassembly of FIG. 6 taken substantially along the line 8—8 of FIG. 7.

With reference to FIGS. 5, 7 and 8, each cable 11 utilized in the illustrated embodiment is of discrete shielded twisted pair type including a pair of electrical conductors or wires 42 which are individually insulated by insulations 43 and twisted together in known manner. Each cable also includes a drain wire 44 for a shield 45 which is surrounded by a cable jacket or sheath 46. The wires 42, herein referred to as signal wires or conductors to distinguish them from the drain wire, are attached as by soldering at insulation stripped ends thereof to respective conductor terminal pads 36 on the printed circuit board 21. The drain wire 44 for each cable 11 is attached as by soldering to the ground bus 23 which can be seen to be in the form of an elongate flat thin strip of conductive metal. Although both wires 42 are herein referred to as signal wires, this is not intended to preclude usage of either wire for purposes other than transmission of electrical signals such as digital signals.

During assembly of the cable termination assembly 10, the cables 11 are organized and the conductors 42, 44 and 45 thereof are properly positioned by use of the wire management comb 18. The comb, which generally is of rectangular block shape, has at the top side thereof a rear row of cable receiving slots 50 which communicate with a forwardly disposed channel 51. At its forward end, the channel 51 is divided by separator walls 52 to form a forward row of wire receiving slots 53. The top side of the comb is also upwardly stepped at its rear portion to provide an elevated top surface 54 which has formed therein a transversely extending channel 55 for receiving and locating the ground bus 23.

In the illustrated embodiment, four cable receiving slots 50 are provided and uniformly spaced apart to receive the cables 11 and to maintain them correspondingly spaced apart. As shown the slots 50 are sized closely to receive the sheathed cables 11 and the side walls of each slot may be provided with inwardly projecting retention ribs 58 which bite into the sheath 46 of the cable to prevent axial shifting of the cable in the slot. One or more retention ribs 58 may be provided with the retention rib or ribs on one side wall of the slot preferably being staggered along the length of the cable with respect to a rib or ribs on the opposite side wall of the slot.

Forwardly of the cable receiving slots 50, the signal wires 42 fan out for passage through respective wire slots 53 at end portions thereof from which the cable shield 45 and sheath 46 have been removed. As for the drain wire 44 of each cable, the exposed end portion thereof is brought upwardly and then rearwardly for attachment as by soldering to the top surface of the ground bus 23 retained in the slot 55 at the top of the wire management comb 18. If the cable is not provided with a drain wire, an end portion of the shield 45 from which the sheath 46 has been removed may similarly be brought up and back for electrical connection to the ground bus. In this manner the drain wires and/or shields of the cable are commonly bussed.

As seen in FIGS. 7 and 8, the bottom of each cable receiving slot 50 is at a lower elevation than the bottom of the channel 51 or slots 53 to accommodate the larger diameter of the cable sheath and to provide a shoulder 60 which further facilitates proper positioning of the cables by butting of the end face of the cable sheath thereagainst. The signal wires 42 extend forwardly from the end of the sheath and into respective wire receiving slots 53. The slots 53 may be provided at the side walls thereof with one or more, preferably staggered, retention ribs 61. The retention ribs 61 bite into the insulation 43 on the signal wires to prevent axial shifting thereof in the slot.

Forwardly of the wire management comb 18, end portions of the signal wires 42 have the insulations 43 stripped therefrom for attachment as by soldering to respective terminal pads 36 on the top surface on the printed circuit board 21. As best seen in FIG. 5, the slots 53 and respective terminal pads 36 are correspondingly spaced apart, as at 0.127 cm. center-to-center spacing, whereby the comb will position and guide the signal wires and then hold them properly aligned with the terminal pads 36 for soldering. Such positioning and guiding of the signal wires relative to the printed circuit board may be further facilitated by use of a jig which holds the wire management comb and printed circuit board in proper relationship during insertion of the cables 11 into the wire management comb and soldering of the wires to the printed circuit board. When assembled together as above described, the printed circuit board, cables and wire management comb together form the subassembly illustrated in FIGS. 5, 7 and 8.

The subassembly of FIGS. 5, 7 and 8 is placed in a mold (if not directly assembled therein or a part of the mold) to mold the balance forming, strain relief body 20 of the housing 13. The end cap 19 also is placed in the mold after having been assembled with respect to the contacts 22 attached to the printed circuit board 21 as above-described. Although not shown, the end cap has a rear wall including plural holes in which the contacts are closely fitted to provide a close off or shut off which prevents molding material from entering and filling the pin receiving chambers of the end cap.

After such loading of the components in the mold, the mold is closed and the balance 20 of the housing 13 is molded, as by injection molding, to such components to form a unified structure therewith. The molded strain relief body 20 preferably encapsulates the electrical junctions between the signal wires 42 and terminal pads 36 on the printed circuit board 21 and those between the contacts and the terminal pads 34. The mold also preferably includes mold cores and/or locating elements for forming cored out areas in the balance forming part of the housing and/or for locating and holding the components in proper position in the mold.

Cored out areas may be provided to reduce material requirements and to avoid thick plastic sections that may be subject to sinking during cooling of the molding material. As seen in FIGS. 3 and 4, relatively large cored out areas 65 are provided on opposite sides of the printed circuit board 21 for these purposes. These cored out areas 65 also may serve as windows permitting access to the printed circuit board as may be desired for some applications. For example, it may be desirable to access a switch provided on the printed circuit board to alter a characteristic thereof. It also may be desirable to mount other electrical devices to the printed circuit board to give the same a certain characteristic or characteristics after the balance forming body 20 has been molded. Such a device may be a programmed or programmable device similar to the devices disclosed in U.S. Pat. Nos. 4,588,239 and 4,609,241 for post-assembly selection of the signal routing performed by the printed circuit board between the cable conductors and the contacts. A cored out area also may be provided in the region of the ground bus 23 as seen at 66. The core elements used to form the cored out areas preferably engage the wire management comb 18 and the printed circuit board 21 to hold them in place in the mold. The wire management comb also would be located properly in the mold by core pins extending through the rivet holes at opposite lateral ends of the comb.

Figure 2:
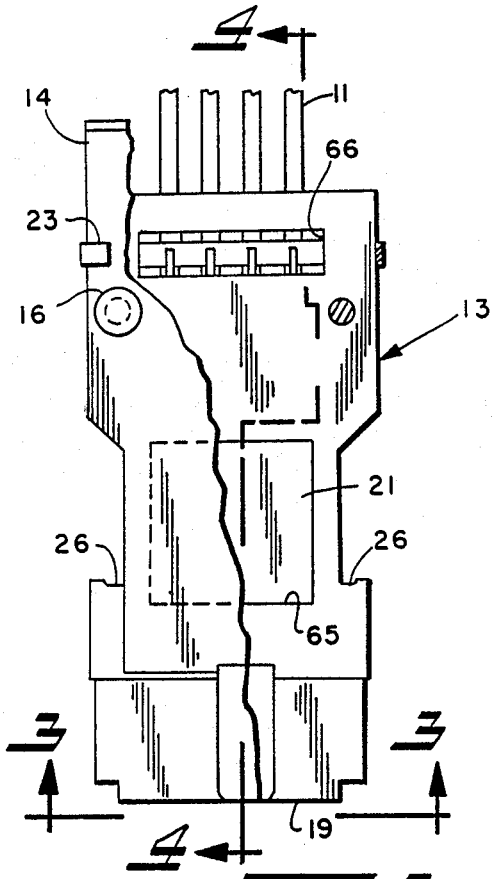
FIG. 2 is a side view, partly broken away in section, of the cable termination assembly of FIG. 1.

After molding of the balance forming part 20, the shield plates 14 and 15 are attached to opposite sides of the housing 13 by the rivets 16 as above-described. Then, the ends of the ground bus 23, which then would be projecting from the sides of the molded strain relief body 20, are bent around and over onto one of the shield plates for soldering thereto as seen in FIGS. 1 and 2. If desired, one end of the ground bus may be soldered to one shield plate and the other end soldered to the other shield plate.

Turning now to FIG. 9, another cable termination assembly according to the invention is indicated generally at 70 The cable termination assembly 70 is adapted for use with round shielded multiple twisted pair cable and, more particularly, two cables 71 of such type. The cables 71 are terminated by a cable termination 72 including a housing 73 and a pair of shield plates 74 and 75 secured to opposite sides of the housing by rivets 76. The edges of the housing are recessed to provide shoulders 77 which may be engaged by locking arms of a header in a manner similar to that above-described with respect to the cable termination assembly 10.

With additional reference to FIGS. 10–13, the housing 73 is composed of a wire management comb 80, a front end cap 81, and a balance forming strain relief body 82 molded directly to the comb and front end cap to form a unified structure therewith. The strain relief body 82 also is molded to and about at least part of a printed circuit board 83, electrical contacts 84, and a ground bus 8E. The end cap 81 is similar to that above-described with respect to the cable termination assembly 10, such end cap 81 accordingly having a plurality of tapered access holes or openings 86 which provide access to respective chambers in the end cap in which respective contacting portions of contacts 84 are accommodated.

The tail portions of the contacts 84 are attached and electrically connected as by soldering to respective contact terminal pads 89 on the printed circuit board 83, the top and bottom sides of which are shown in FIGS. 14 and 17, respectively. Again, the contacts may be arranged in a dual-in-line pattern with the contacts of one row being attached to terminal pads on one side of the printed circuit board and those in the other row being attached to terminal pads on the other side of the printed circuit board. The contact terminal pads 89 on each side of the printed circuit board are arranged along the forward edge of the board whereas other terminal pads 90 are arranged along the rear edge of the board for attachment thereto of conductors of the cables 71. As seen in FIGS. 14 and 17, one side of the printed circuit board may have the terminal pads 90 located along the rear edge thereof at a center-to-center spacing equal to one-half the center-to-center spacing of the contact terminal pads 89 while the other side of the printed circuit board may have provided thereon a plurality of ground bus pads 91–93 to which wire conductors at different ground potentials may be attached. As further shown, the printed circuit board has printed circuit traces 94 and plated through holes 95 for electrically connecting terminal pads at one end thereof to terminal pads at the other end thereof to provide a desired interconnect pattern.

Like the above-described wire management comb 18, the wire management comb 80 functions to organize and guide the conductors of the cables 71 to proper position with respect to the terminal pads 90 at the rear end of the printed circuit board 83. As seen in FIGS. 14–16, the comb 80, which generally is of rectangular block shape, has at the top side thereof a rearward wall section 98 including a plurality of laterally spaced apart slots 99. The comb also has outer side walls 100 extending forwardly from the rearward wall section 98 and defining therebetween a channel-like area which is divided by a plurality of laterally spaced separator walls 101 to form a forward row of wire receiving slots 102. The separator walls 101 rearwardly terminate short of the rear wall section 98 to form a wire transition region 103 between the two rows of slots. The rearward wall section 98 has a slightly elevated top surface 104 which has formed therein a transversely extending recess or channel 105 for receiving and locating the ground bus 85.

In the illustrated embodiment, the rear row of slots 99 has the same center-to-center spacing as the forward row of slots 102, although the forward row has one less slot and the rear row of slots are offset with respect to the forward row of slots by one-half the center-to-center spacing thereof. Each slot 99 in the rearward row preferably has a width and height dimension sufficient to accommodate therein a twisted wire pair of shielded or unshielded type. It is noted that the cables 71 of the indicated type may include both shielded and unshielded twisted pairs, and such twisted pairs may be organized by placement in respective slots 99 at the rear of the wire management comb 80. Further with regard to such organizing of the twisted pairs of the cables, the outer sheaths of the cables may terminate at 108 in FIG. 13 and from there the twisted pairs may fan out to respective slots 99 at the rear of the wire management comb. It also is noted that the shield of each cable may extend beyond the end of the sheath and brought to the ground bus 85 for electrical and mechanical attachment thereto.

In FIGS. 14–16, a representative unshielded twisted pair is indicated at 110 and can be seen to include two signal wires 111 and 112 which both may be retained within a single slot 99 at the rear end of the wire management comb 80. From this slot the signal wires 111 and 112 of such pair 110 each pass forwardly to and through a wire receiving slot 102 at the front end of the wire management comb for guidance to proper position with respect to the printed circuit board. The signal wires 111 and 112 are stacked one atop the other in a single wire receiving slot 102 for passage out of the slot at different elevations. This facilities guidance and attachment of the top signal wire 111 to a terminal pad 90 at the top side of the printed circuit board 83 and the bottom signal wire 112 to the therewith aligned one of the ground bus pads 91–93 at the bottom side of the printed circuit board. This arrangement may be used, for example, where one of the signal wires carries digital signals and is to be attached to one side of the printed circuit board whereas the other signal wire is maintained at ground potential and is to be attached to a ground bus pad at the bottom side of the printed circuit board perhaps commonly with signal wires of other twisted pairs that are to be maintained at a common ground reference potential.

The wire management comb 80 permits wire management arrangements other than that just described. For example, the signal wires 114 and 115 of a twisted pair 116 may be located in respective different slots 102 at the forward end of the wire management comb as shown in FIGS. 14–16. Also, a shielded twisted pair 117 may have the outer sheath thereof received in a slot 99 in the rearward row. Forwardly of the slot 99 the sheath is stripped to allow independent passage of the signal wires 118 and 119 to and through respective different slots 102 at the forward end of the wire management comb. A shielded twisted pair typically would also have a drain wire 120 which may be brought up and back for attachment to the ground bus 85.

It should be understood that the foregoing wire management arrangements indicate only a few of various wire management arrangements that may be obtained by using the wire management comb 80. Such a comb additionally may be used, for example, with flat ribbon, twisted pair cable. In this latter case, the plural twisted pairs of the cable may be received in respective different ones of the slots 99 with the signal wires thereof extending forwardly for passage through respective wire receiving slots 102 which serve to align properly the signal wires with terminal pads 90 at the rear end of the printed circuit board 83 either at the top or bottom side of the printed circuit board.

After the various electrical connections have been made between the conductors of the cables 71, the ground bus 85, the printed circuit board 83 and the contacts 84, the resultant subassembly may then have molded thereto the strain relief body 82. The mold utilized preferably includes mold cores and/or locating elements for forming cored out areas and/or for locating and holding the subassembly in proper position in the mold. After such molding, the shield plates 74 and 75 are attached to opposite sides of the housing 73 by the rivets 76 and the ends of the ground bus 85 extending from the sides of the molded strain relief body 82 may be bent around and over onto one or respective ones of the shield plates for soldering thereto as seen in FIG. 9.

Figure 18:
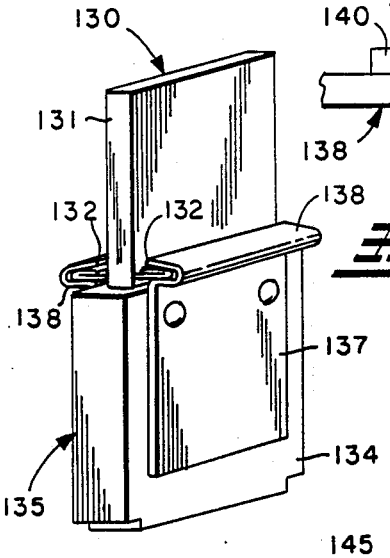
FIG. 18 is a schematic perspective view depicting in partially assembled condition another cable termination assembly according to the invention.
Figure 19:
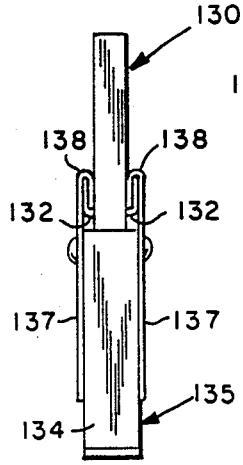
FIG. 19 is a schematic edge side view of the cable termination assembly of FIG. 18 in fully assembled condition.

Referring now to FIGS. 18–28, several techniques for terminating the wraparound shield of flat ribbon cable are illustrated. In FIGS. 18 and 19, a flat ribbon cable 130 has a wraparound shield 131. The wraparound shield 131 at the terminating end thereof has opposite side walls thereof folded outwardly along their widths to form ear-like or tab-like end portions 132 at opposite sides of the cable 130. The shield 131 may be of the type including an inside layer of conductive material such as aluminum or copper and an outer layer or substrate of mylar/polyester. With this type or similar type of shield, the projecting side walls of the shield preferably are reversely folded inside out so that the conductive side thereof is exposed at both sides of the then formed double layer ears or tabs 132.

The cable 130 or the conductors thereof extend beyond the ears 132 and are terminated at contacts within the housing 134 of cable termination 135. The cable termination 135 may be of any suitable type for terminating the conductors of the cable; although, preferably, the housing 134 of such cable termination has at least a part thereof molded to the cable, contacts and/or conductors to form a unified structure therewith.

Shield plates 137 are then secured as by rivets to the sides of the housing 134. The shield plates 137 have rear end portions 138 extending rearwardly beyond the housing 134 which are bent outwardly and then inwardly to form linear crimp clamps. The crimp clamps are generally U-shape and open inwardly to receive in the bight thereof respective ears 132. With the ears 132 received within the crimp clamps 138 as shown in FIG. 18, the side walls of the crimp clamps are crimped together to sandwich therebetween the ears 132. The then crimped clamps or end portions 138 of the shield plates 137 preferably are folded rearwardly to align with the major planar extents of the shield plates as seen in FIG. 19.

Figure 20:
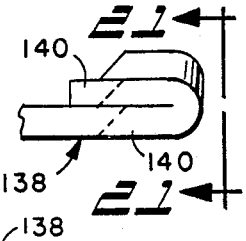
FIG. 20 is a partial end view of a preferred form of crimp clamp employed in the assembly of FIG. 19.
Figure 21:
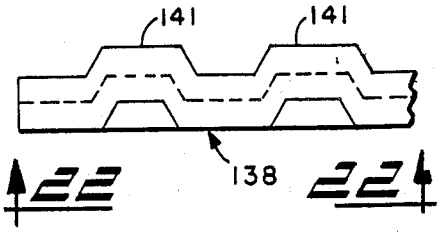
FIG. 21 is a partial edge elevational view of the crimp clamp looking generally in the direction of the arrows 21—21 of FIG. 20.
Figure 22:
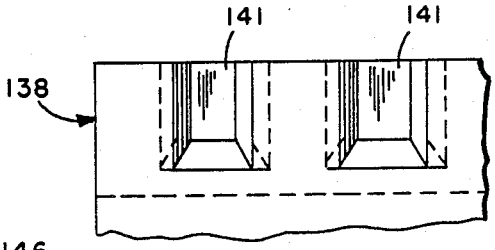
FIG. 22 is a partial plan view of the crimp clamp looking generally in the direction of the arrows 22—22 of FIG. 21.

In FIGS. 20–22 there is illustrated a preferred form of crimp which provides a secure union between the shield plates and the cable shield ears or tabs. As shown, the sides or legs 140 of each linear crimp clamp 138 are upset at locations 141 laterally spaced along the length of the crimp clamp. The cable shield ears 132 accordingly would be similarly deformed to provide a mechanical lock between the ear and the crimp clamp. Also, such plastic deformation of the upset portions 141 strain hardens the crimp clamp further to contribute to a secure union. The upset portions 141 of the crimp clamp may have the illustrated generally frusto-pyramidal shape as is preferred.

Figure 23:
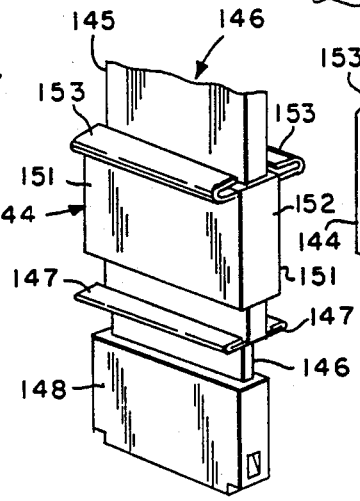
FIG. 23 is a schematic exploded perspective view of another cable termination assembly employing a box shield with shielded flat ribbon cable.
Figure 24:
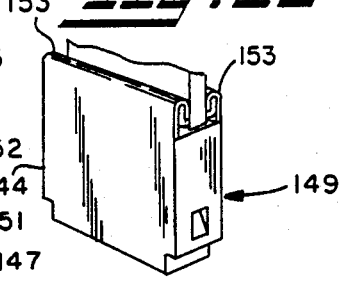
FIG. 24 is a schematic partial perspective view of the cable termination assembly of FIG. 23 in fully assembled condition.

In FIGS. 23 and 24 the illustrated termination technique involves the use of a metal box shield 144 to terminate the wraparound shield 145 of cable 146. The wraparound shield 145 at the terminating end thereof has opposite side walls thereof folded outwardly to form ear-like or tab-like end portions 147 at opposite sides of the cable 146. The cable 146 or the conductors thereof extend beyond the ears 147 and are terminated at contacts within the housing 148 of cable termination 149.

The metal box shield has side walls 151 and end walls 152. The side walls 151 have rear end portions 153 which are bent outwardly and then inwardly to form linear crimp clamps substantially like those above-described. The crimp clamps 153 are generally U-shape and open inwardly to receive in the bight thereof the ears 147 after sliding of the box shield over the housing 148. With the ears 147 received within the crimp clamps 153 the side walls of the clamps are crimped together to sandwich therebetween the ears. The thusly crimped clamps or end portions 153 of the box shield preferably are then folded rearwardly to align with the major planar extents of the respective side walls of the box shield as seen in FIG. 24.

Figure 25:
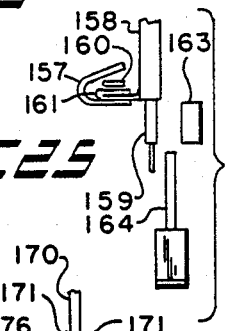
FIG. 25 is a schematic exploded elevational view of another cable termination assembly in partially assembled condition.
Figure 26:
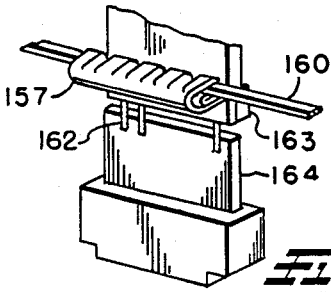
FIG. 26 is a schematic perspective view of the cable termination assembly of FIG. 25 in a further assembled condition.
Figure 27:
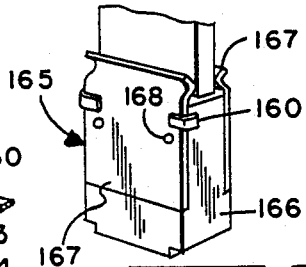
FIG. 27 is a schematic perspective view of the cable termination assembly of FIG. 25 in fully assembled condition.

FIGS. 25–27 illustrate use of a discrete linear crimp clamp 157 for effecting quick and secure mechanical and electrical connection of the shield 158 of cable 159 to a shield ground bus 160. The shield 158 has a side wall thereof folded outwardly to form an ear-like or tab-like end portion 161. The ground bus strip 160 is then placed in juxtaposition with the ear 161 and the crimp clamp 157 is placed thereover as seen in FIG. 25. The crimp clamp then is crimped to join together the cable shield and ground bus. The conductors 162 of the cable extending beyond the end the cable shield 158 may be organized by wire management comb 163 and attached to printed circuit board 164 substantially as above-described in connection with the cable termination assembly 10. Overall, the assembly of the cable termination assembly shown at 165 in FIG. 27 is substantially similar to that of the cable termination 10 except that shielded flat ribbon is used and that the crimp clamp 157 is used to effect electrical connection of cable shield 158 to the ground bus. The crimp clamp preferably is encased within the molded body 166 of the assembly 165 while the ends of the ground bus extend beyond the ends of the crimp clamp and also from the sides of the molded body 166 for soldering to one or respective ones of shield plates 167 secured by rivets 168 to the molded body 166.

Figure 28:
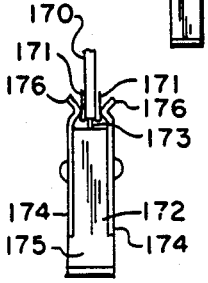
FIG. 28 is a schematic edge side view of another cable termination assembly illustrating still another technique for terminating shielded flat ribbon cable.

FIG. 28 shows still another technique for terminating the wraparound shield of flat ribbon cable or the like. The wraparound shield 170 at the terminating end thereof has opposite side walls thereof each folded back upon itself as seen at 171 to expose the conductive inner layer thereof. After assembly of a cable termination 172 to the end of the cable 173 extending beyond the shield 170, shield plates 174 are secured to opposite sides of the cable termination housing 175. The shield plates extend beyond the rear end of the housing and have end portions 176 that are curved inwardly and then outwardly as shown to engage therebetween the cable to provide strain relief and also electrically to connect with the folded back end portions 171 of the shield.

Referring now to FIGS. 29–32, another cable termination assembly according to the invention is indicated generally at 200. The cable termination assembly 200 is similar in many respects to the above described cable termination assembly 10, but provision is made for direct connection of cable conductors to respective contacts thereby eliminating the need for a printed circuit board interface and an additional row of connections required by the printed circuit board interface. Nevertheless, it still may be desirable for many applications to employ a printed circuit board interface.

The cable termination assembly 200 includes plural discrete cables 201 and a cable termination 202 for terminating the cables. Although seven discrete cables 201 are shown, the number thereof may vary as desired for any given application and the discrete cables may be tied, bundled, or otherwise joined together as desired. In the illustrated preferred embodiment, the cables are of shielded twisted pair type. However, other types of cable may be utilized as may be desired for various applications including even a single cable with a single conductor, although principles of the invention have greater applicability to mass termination of multiple conductors. For example, various principles of the present invention may be adapted for flat ribbon cable and round shielded twisted pair cable including multiple twisted pair cables or cables of other types.

The cable termination 202 includes a housing 203 and a pair of shield plates 204 and 205 mechanically secured to opposite sides of the housing 203 and, of course, preferably electrically connected to each other by rivets 206. The shield plates 204 and 205 extend beyond the rear (cable) end of the housing 203 and are curved towards and then away from one another as shown to engage therebetween the cables 201. The thusly curved ends of the shield plates 204 and 205, respectively indicated at 206 and 207, provide strain relief by defining a minimum bending radius for the cables 201 exiting from the rear end of the housing 203. More particularly, the curved ends 206 and 207 of the shield plates have gradually curved facing surfaces 208 and 209, respectively, which control bending of the cable and insure a large radius of bend should the cables be flexed with respect to the termination 202 in a direction generally perpendicular to the planar extent of the termination 202. The projecting curved ends 206 and 207 of the shield plates 204 and 205 also function to maintain the discrete cables 201 in generally coplanar relationship and located between a pair of bending guides 210 and 211.

As seen in FIGS. 33 and 34, wherein the termination assembly 200 is shown prior to assembly of the shield plates there, the cable bending guides 210 and 211 are rearward extensions of the housing 203. The guides are located on opposite sides of the planar arrangement or array of cables 201 and have a thickness which is about equal to the diameter (thickness) of the cables. The laterally inner surfaces 214 and 215 of the cable guides are gradually curved outwardly to define a large minimum bending radius for the adjacent cables. As will be appreciated, only the outermost cable at each side of the cable array normally will engage the corresponding bending guide, but then such cable would function as a bending guide for the next adjacent cable, and so on, because the cables are maintained coplanar by the projecting ends of the shield plates 204 and 205. Accordingly, the bending guides ensure a large bending radius for the cables when flexed laterally with respect to the termination 202 while the curved projecting ends of the shield plates define a large minimum bending radius for the cables when flexed in a direction generally perpendicular to the planar extent of the termination. Preferably, the curved bending guide surfaces 208, 209, 214 and 215 each have a radius at least twice the diameter of the cables and they function to prevent bending the cable relative to the housing 203 at such a sharp angle that might damage the cable, change impedance characteristics, etc.

The edges of the housing 203 are recessed to provide shoulders 217 which may be engaged in known manner by locking arms on a header, panel mounted connector, etc., to lock the cable termination 202 to the header or other mating device The cable termination may mate with a header in a manner similar to that illustrated in FIG. 4 in connection with the cable termination assembly 10. Accordingly, the mating header preferably is of shielded type having shield plates for engaging and electrically connecting with the shield plates 204 and 205 of the cable termination such as in a manner similar to that illustrated in FIG. 4. The housing also is provided with polarizing keys 218 and 219 on opposite sides thereof for mating in corresponding key slots in the mating header or other device. However, other conventional polarizing or keying mechanisms may be provided if desired.

As best seen in FIGS. 35–38, the housing 203 is composed of a conductor-contact management comb 222, a front end cap 223 and a balance forming, strain relief body 224 molded directly to the comb and front end cap to form a unified structure therewith The strain relief body 224 also is molded to and about at least parts of other components of the cable termination 202 to secure the same with respect to one another. These other components include electrical contacts 225, a drain bus 226 and a ground bus 227. The strain relief body also is molded to and about end portions of the cables 201. As will be appreciated, the illustrated cable termination assembly is a two ground system including the drain (first or shield ground) bus 226 as part of one ground along with the shields of the cables 201 and including the (second) ground bus 227 as part of a second ground along with one of the conductors of the twisted pair cables 201.

The conductor-contact management comb 222 functions as a locating device for positioning the several components of the cable termination assembly 200 with respect to one another during assembly and also in the finished assembly. The cables 201 are organized and the conductors thereof are properly positioned by the conductor-contact management comb with respect to one another and also with respect to tail portions 228 of the contacts 225, the drain bus 226 and the ground bus 227. Provision also is made for properly locating the end cap 223 with respect to the conductor-contact management comb and thus with respect to the various other components of the cable termination assembly.

In FIGS. 39–46, the conductor-contact management comb 222 can be seen to include a pair of generally parallel, longitudinally extending side walls 231 and 232 and four bar-like body sections 233–236 extending laterally between the side walls 231 and 232. The body sections are tied together in generally coplanar and parallel relationship by the side walls. The side walls 231 and 232 and body sections 234, 235 and 236 are of about the same height, while the body section 233 is of greater height. For reference purposes, the body sections 233, 234, 235 and 236 are herein referred to as the first, second, third and fourth body sections, respectively.

The rearwardmost or first body section 233 and next adjacent second body section 234 are longitudinally spaced apart and define therebetween an opening 240 forming part of a wire transition zone 241. The second body section 234 also is longitudinally spaced from the next forwardly adjacent third body section 235 to form therewith a ground bus access opening 242. In turn, the body section 235 is longitudinally spaced from the forwardmost body section 236 to form therewith a contact access opening 243. The body sections 233–236 are perpendicular to the side walls 231 and 232, and the openings or apertures 240, 242 and 243 extend laterally between the side walls 221 and 222.

The first body section 233 is provided with cable receiving slots 245 which are uniformly spaced apart. The slots 245 open to the top surface 246 of the first body section 233 and the slots may be provided with outwardly flared entranceways 247 (FIG. 41) to facilitate insertion of cables into the slots. The first body section also has formed in the top side thereof a transversely extending channel 248 for receiving and locating the drain bus 226 (see FIGS. 35 and 37). The channel 248 extends from one side of the conductor-contact management comb to the other side of the management comb.

Figure 43:
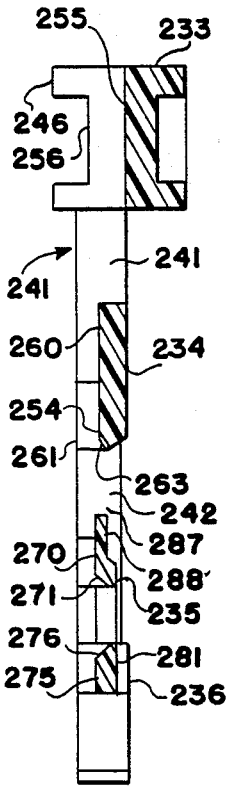
FIG. 43 is a longitudinal sectional view of the conductor-contact management comb of FIG. 39 taken along the line 43—43 of FIG. 39.
Figure 39:
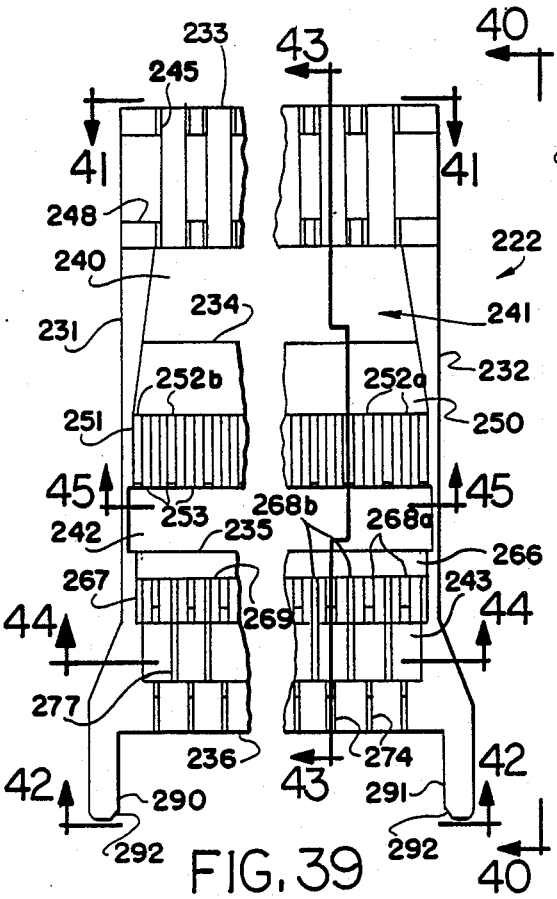
FIG. 39 is a top plan view of the conductor-contact management comb used in the modified cable termination assembly of FIG. 29.
Figure 40:
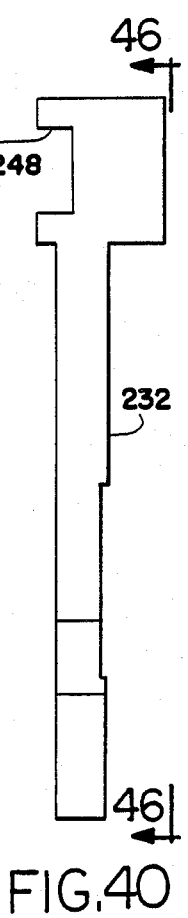
FIG. 40 is an edge side view of the conductor-contact management comb of FIG. 39 looking in the direction of the arrows 40—40 of FIG. 39.
Figure 42:
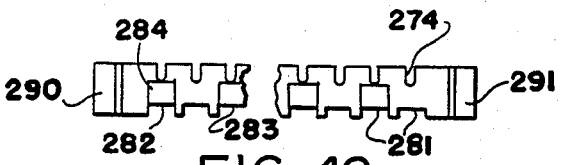
FIG. 42 is a front end view of the conductor-contact management comb of FIG. 39 looking in the direction of the arrows 42—42 of FIG. 39.

The second body section 234 has a rearward shelf portion 250 and a slotted forward portion 251. The slotted forward portion 251 is provided with a plurality of insulated wire or conductor slots 252a 252b (jointly referenced by reference numeral 252) which are uniformly spaced apart by divider walls 253. The wire slots 252 are sized closely to, receive insulated conductors of twisted pair cables; that is, the width of the slots is approximately equal and preferably slightly less than the outer diameter of insulation surrounding individual wire conductors of twisted pair cable employed in the assembly 200. As seen in FIG. 43, the bottom 254 of each wire slot is at a higher elevation than the bottom 255 of the cable receiving slots 245. It also can be seen in FIG. 43 that the bottom 255 of each cable receiving slot is at a lower elevation than the bottom 256 of the drain bus channel 248. The rearward portion 250 of the second body section 234 has a top surface 260 recessed in relation to the top surface 261 of the slotted forward portion 251 of the second body section. The top surface 260 preferably is at the same elevation as the bottoms 254 of the wire receiving slots 252. The rearward shelf portion 250 provides a surface to use in ejecting the management comb from the mold in which it is made.

In the illustrated conductor-contact management comb 222, the second body section 234 has a total of 21 slots 252 divided by 20 divider walls 253 with the outermost slots being formed between a divider wall and adjacent side wall 231, 232 of the management comb. Ten of these slots, herein designated primary 252a slots to facilitate description, are formed between respective pairs of divider walls 253 while the remainder of the slots, herein designated secondary slots 252b, alternate with the primary slots 252a. At the lower forward edge of each secondary slot, there may be provided a slight chamfer 263.

Like the second body section 234, the third body section 235 also may have a rearward shelf portion 266 and a slotted forward portion 267. The slotted forward portion 267 has a plurality of upward opening primary wire receiving slots 268a which alternate with secondary wire receiving slots 268b. The primary wire receiving slots 268a are formed between respective pairs of divider walls 269 whereas the secondary slots 268b are formed between adjacent divider walls of such pairs thereof. The primary slots 268a are equal in number to, longitudinally aligned with and approximately the same width as the primary slots 252a in the second body section 234. The secondary slots 268b, however, are relatively narrower in width and preferably have a width approximately equal or slightly less than the diameter of the wire conductors of the cables. The bottom of each primary slot 268a has a rearward portion 270 approximately at the same elevation as the bottom 254 of each wire receiving slot 252 in the second body section 234 and a forward downwardly sloping portion 271 as seen in FIG. 43. The bottom of each secondary slot 268b may be at approximately the same elevation as the rearward bottom portion 270 of the primary slots 268a, and the top surface of the rearward shelf portion 266 also may be at such elevation Like the shelf portion 250, the shelf portion 266 provides a surface for use in ejecting the comb from a mold.

The fourth body section 236 is provided with a plurality of wire receiving slots 274 which are uniformly laterally spaced apart and longitudinally aligned with respective primary slots 268a of the third body section 235, and, therefore, also the primary slots 252a of the second body section 234. The wire receiving slots 274 preferably have a width approximately equal and preferably slightly less than the diameter of the wire conductors of the cables 201. The bottom of each slot 274 has a forward portion 275 at the same elevation as the rearward portion 270 of slot 268a and a downwardly sloping rearward portion 276.

Figure 44:
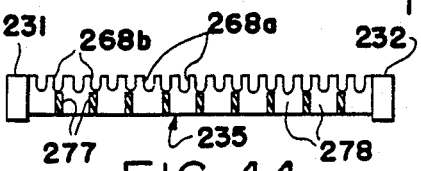
FIG. 44 is a transverse sectional view of the conductor-contact management comb of FIG. 39 taken along the line 44—44 of FIG. 39.
Figure 45:
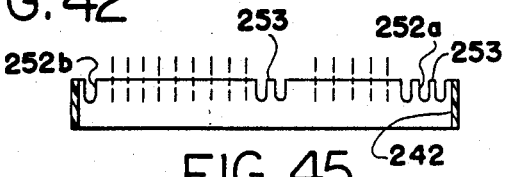
FIG. 45 is a transverse sectional view of the conductor-contact management comb of FIG. 39 taken along the line 45—45 of FIG. 39.
Figure 46:
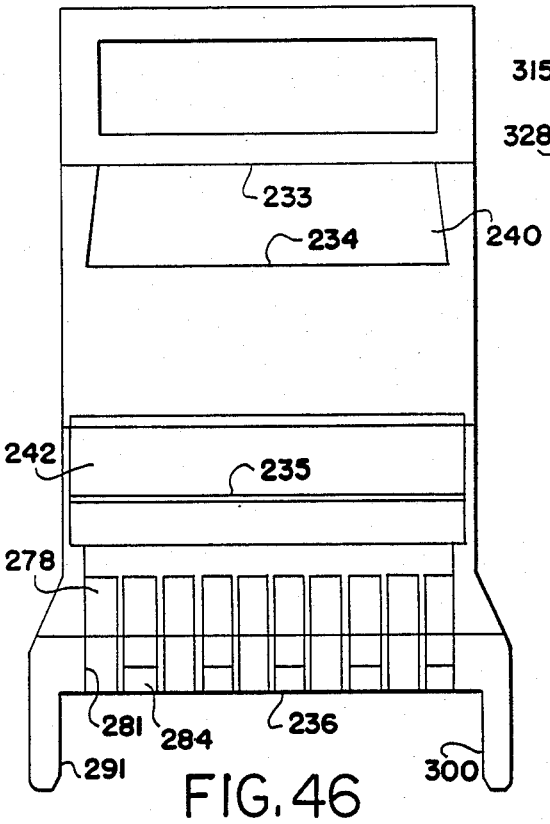
FIG. 46 is a bottom view of the conductor-contact management comb of FIG. 39 looking in the direction of the arrows 46—46 of FIG. 40.

The contact access opening 243 between the body sections 235 and 236 is divided by divider walls 277 extending longitudinally between the body sections 235 and 236. The divider walls 277 are uniformly laterally spaced apart and form therebetween guide channels 278 as seen in FIG. 44. In the illustrated embodiment, there are nine divider walls 277 forming ten wire guide channels 278. The divider walls 277 are located centrally between respective pairs of wire slots 274 in the fourth body section 236 and also in line with respective secondary slots 268b of the third body section 235.

At the bottom side of the body section 236, there is provided a row of contact locating recesses or slots 281 which are uniformly laterally spaced apart and longitudinally aligned with respective guide channels 278 formed between the divider walls 277. Every other contact locating recess has a rearward bottom surface 282 coplanar with the bottom surfaces 283 of the other recesses and a forward upwardly sloping surface 284 for a reason that will become more apparent from the following description.

Figure 36:
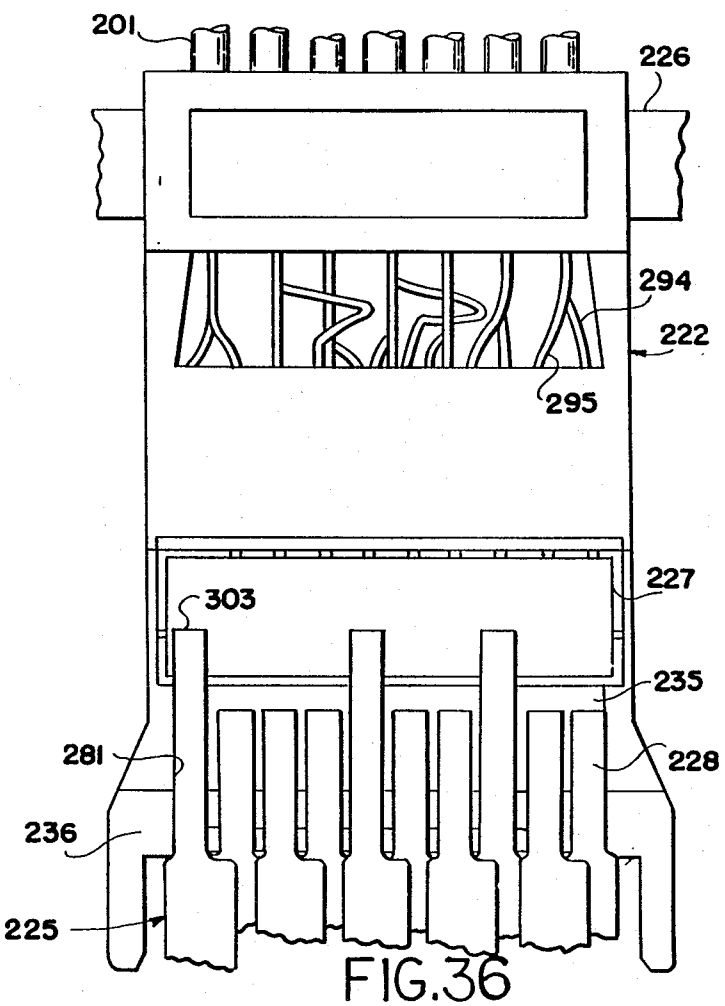
FIG. 36 is a bottom plan view of the conductor-contact management comb subassembly.
Figure 37:
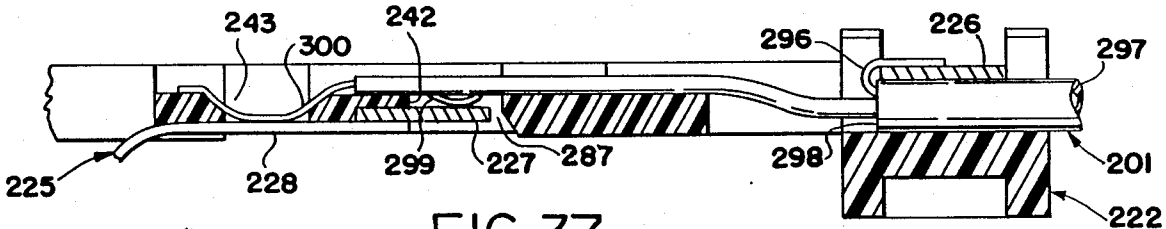
FIG. 37 is a sectional view taken substantially along the line 37—37 of FIG. 35.
Figure 38:
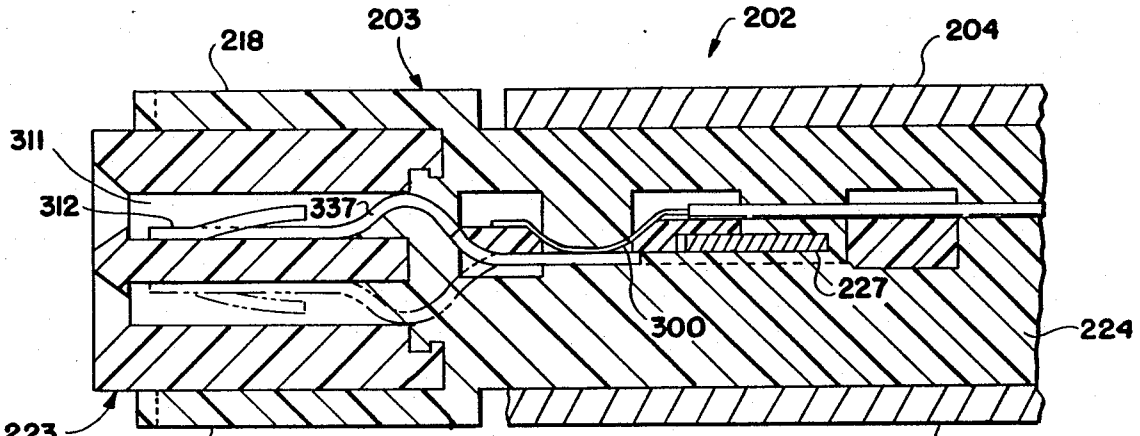
FIG. 38 is a sectional view taken substantially along the line 38—38 of FIG. 35.
Figure 41:
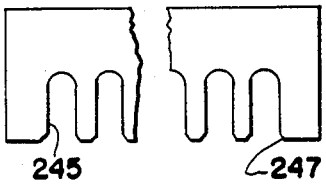
FIG. 41 is a rear end view of the conductor-contact management comb of FIG. 39 looking in the direction of the arrows 41—41 of FIG. 39.

The conductor-contact management comb also is provided at the bottom thereof with a ground bus receiving area or recess 287. The ground bus receiving area 287 is in part formed by the lower portion of the ground bus access opening 242 and a recess 288 provided in the underside of the third body section 235. As seen in FIGS. 36–38, the ground bus 277 may be located in the ground bus recess 287 with the rearward portion thereof exposed to the top side of the conductor-contact management comb by the ground bus access opening 242.

The conductor-contact management comb 222 also is provided with a pair of locating tabs 290 and 291 projecting forwardly from the fourth body section 236 at respective sides thereof The locating tabs 290 and 291 provide for proper positioning of the conductor-contact management comb with respect to the end cap 223 containing the contacts 225. The locating tabs are generally rectangular in cross-sectional shape and at their leading ends have chamfers 292 at their inside edges to facilitate insertion into. corresponding guide holes provided in the end cap, as will be seen below.

Reverting back to FIGS. 35–38, each cable 201 to be organized and properly located by the conductor-contact management comb 222 includes a pair of electrical conductors or wires 294 and 295 which are individually insulated and twisted together in known manner. Each cable also includes a drain wire 296 for a shield (not shown) which is surrounded by a cable jacket or sheath 297. One wire 294 of each cable may be referred to as signal wire and the other wire 295 as a ground wire to distinguish them from one another and from the drain wire 296. This designation of the wires as signal and ground wires, however, is not intended to preclude usage of either wire for transmission of electrical signals such as digital signals or for purposes other than transmission of electrical signals. Typically, the signal or operational wire would be used to transmit electrical signals while the other or ground wire is maintained at ground or reference potential.

The manner in which the cables 201 and their conductors 294 and 295 are located and held in the conductor-contact management comb 222 will now be described in connection with the manner in which the cables and conductors are assembled with respect to the conductor-contact management comb. Prior to placement of the cables and their conductors into the conductor-contact management comb, the sheaths 297 are stripped from the ends of the cables to expose preferably equal lengths of the signal and ground conductors 294 and 295. At the same time, the cable shields may be stripped away and the exposed drain wires 296 may be cut to leave only short exposed end portions extending from the ends 298 of the cable sheaths. Also, the exposed insulations on the signal and ground conductors 294 and 295 are partly stripped away to expose preferably equal length and portions of the conductors. Consequently, each thusly prepared cable is essentially identical to each other prepared cable.

The thusly prepared cables 201 then are placed in the conductor-contact management comb 222 in any suitable manner but preferably by use of a computer programed X–Y table. More particularly, the sheathed portions of the cables are placed in respective cable receiving slots 245 in the first body section 233 preferably with a close fit for retention of the cables in the slots. The slots 245 maintain the sheathed cables in laterally spaced apart and coplanar relationship. Preferably the cables are longitudinally located such that the ends 298 of the sheaths 297 are located proximate the leading edge of the drain bus slot 248.

After the sheathed cables 201 have been placed in the cable receiving slots 245, the drain bus 226 is placed in the drain bus slot 248 in the first body section 233. The drain bus 226 is an elongate flat thin strip of conductive metal and spans the open upper ends of the cable receiving slots 245. The drain bus also has end portions projecting laterally beyond the sides of the conductor-contact management comb 222. Preferably, the drain bus is held in the slot 248 with a press fit and functions to hold the cables in place until the strain relief 224 is molded on.

Figure 35:
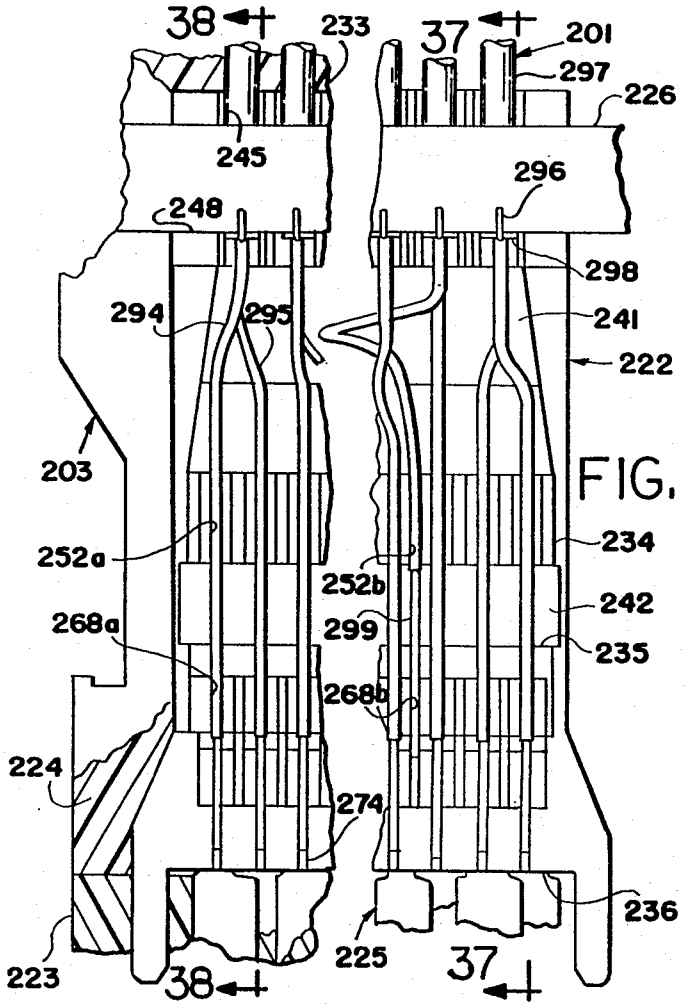
FIG. 35 is an enlarged fragmentary view similar to FIG. 33 but with substantial portions of the termination housing and end cap broken away to illustrate a subassembly including the cables and conductor-contact management comb.

After placement of the drain bus 226 in the drain bus slot 248, the exposed end portion of each drain wire 296 is bent up and then rearwardly for attachment as by soldering to the top surface of the drain bus as seen in FIGS. 35 and 37. If the cable is not provided with a drain wire, an end portion of the cable shield from which the outer sheath has been removed may similarly be brought up and back for electrical connection to the drain bus. In either manner, the drain wires and/or shields of the cables are commonly bussed.

Forwardly of the first body section 233, the signal and ground wires 294 and 295 fan out in the wire transition zone 241 for receipt and retention in respective slots 252 in the second body section 234. Typically, the signal wires or ground wires to be connected to respective contacts 225 are placed in the primary slots **252*a* and the other ground or signal wires to be connected to the ground bus 227 are placed in the secondary slots 252*b*. Preferably, the slots 252 receive the insulated portions of the conductors to provide for secure press fit retention of the conductors in the slots. The upper portions of bordering divider walls 253** may be mushroomed over the conductors as by a blunt tool or hot bar to close at least partly the tops of the slots to prevent the conductors from inadvertently becoming dislodged from the slots. Such press fit and/or mushrooming may be employed in conjunction with the other slots, associated divider walls and/or cables received therein.

From the second body section 234, the signal and ground conductors 295 extend forwardly for receipt in respective slots 268 in the third body section 235. The conductors to be connected to contacts preferably are received in primary slots **268*a* of the third body section and have the stripped end portions thereof extending longitudinally across the contact access opening 243 to respective slots 274 in the fourth body section 236 where the stripped distal end portions of the conductors are received and held in the slots 274. As for the other conductors to be connected to the ground bus 227, preferably such conductors are kinked or bent in the transition zone 241 as seen in FIGS. 35 and 36 thereby to locate the stripped end portions of such conductors rearwardly of the stripped end portions of the other conductors to be attached to contacts. More particularly, the conductors which are bent as described each have the stripped end portions 299 thereof extending longitudinally across the ground bus access opening 242 and their stripped distal end portions received and held in the secondary slots 268*b* in the third body section 235**.

As seen in FIGS. 37 and 38, the stripped end portions 300 of the conductors 294, 295 extending longitudinally across the contact access opening 243 are bent downwardly through respective guide channels 278 to engagement and electrical connection with the tail portion 228 of a respective contact 225. Preferably, the intermediate section of the conductor from which the insulation has been removed is bent or bowed downwardly to engagement with the contact tail portion by an electrode of a spot welding device which can simultaneously spot weld the conductor to the contact thereby providing a secure mechanical and electrical connection between the conductor and the contact. However, the conductor could otherwise be brought to engagement with and/or attached to the contact tail by other means such as by soldering.

In similar manner, those conductors, for example, the ground conductors, to be attached to the ground bus 227 are bent or bowed downwardly such as by the electrode of a spot welding device for attachment to the top surface of the ground bus 227 at the exposed end portions 299 thereof, as seen in FIG. 37. In this manner, for example, the ground conductor of each cable may be attached to the ground bus and thereby commonly bussed while the other or signal conductors may be attached to the tails of respective contacts.

During attachment of the conductors 295 to the tails 228 of the contacts 225, the tails 228 are held in the contact receiving slots 281 at the bottom side of the fourth body section 236. The contact receiving slots 281 properly locate and align the contact tails with the conductors, and the contact tails extend longitudinally rearwardly from the fourth body section 236 with each tail preferably at least slightly overlapping the underside of the third body section 235 as shown in FIG. 36. It also is noted that the divider walls 277 function to maintain the intermediate portions of the exposed ends 300 of the conductors laterally spaced apart from like portions of adjacent conductors to prevent short circuits in the region of the contact access opening 243.

As seen in FIGS. 36 and 37, several of the contact tails 228 are extended rearwardly to overlap the underside of the ground bus 227 for electrical connection therewith. In actuality the other non-extended contact tails have been truncated as by mechanically nipping same so they terminate short of the ground bus. The overlapping ends 303 of these contacts are spot welded to the ground bus as is preferred or they could otherwise be attached to the ground bus if desired. The ground bus thereby may be electrically connected to one or more conductive elements of an external device to which the cable termination assembly is mated. If desired, the tails of all the contacts may be of equal length and the ground bus may be provided with forwardly extending fingers for overlapping the tails of those contacts to be electrically connected to the ground bus. Also, the ground bus may be segmented to form plural separate ground busses if desired with respective conductors and/or contacts attached to each such separate or sub-bus, as might be needed for systems requiring plural separate ground bus systems.

As is preferred, the spot welding of conductors to the contacts and ground bus is effected by using a computer programmed X–Y table for positioning the cable loaded conductor-contact management comb relative to a spot welding electrode which may be moved in a direction perpendicular to the plane of the table for depressing and welding the conductors to the contacts and ground bus in accordance with a programmed sequence. During such downward depressing of the wire conductors, the several chamfers 263, 271, and 276 which border the acces openings 242 and 243 function to form the wires into a relatively large radius thereby to avoid sharp bends that might damage the wires or adversely impact their performance.

As above indicated, the contact tails 228 are positioned at the bottom side of the conductor-contact management comb and located in respective contact receiving slots 281. This of course is effected before connection of the conductors to the contacts. To facilitate this placement and properly to locate the contacts as they are assembled with the conductor-contact management comb, preferably the contacts are first retained in the end cap 223 which will now be described along with a preferred form of contact.

In the illustrated cable termination which is of female type, the end cap 223, as seen in FIGS. 38 and 47–50, has in a front wall thereof a plurality of tapered access holes 310 or openings 310. The access holes 310 provide access to respective chambers or cells 311 in the end cap in which respective front end portions 312 (FIG. 38) of the contacts 225 are contained as seen in FIG. 38. It should be understood, however, that principles of the subject invention may be applied to cable terminations other than female type, such as those of male type having outwardly protruding pin type contacting portions in which the end cap may be eliminated or appropriately modified. More generally, the front end of the cable termination may be modified for any number of different applications. The end cap preferably is made of plastic or plastic-like material that can be injection molded.

The cells or chambers 311 in the end cap 223 are formed in such a way to provide desired support and positioning functions for the contacts 225 and to guide a pin contact or other external member into the cell for making an electrical connection with the contacts. At the front end of the cap the tapered holes or openings 310 permit insertion of a pin contact into the cell 311 for electrical connection with a respective electrical contact. Such electrical connection ordinarily is non-permanent, especially relative to the permanency of electrical junctions between the contacts and respective conductors of the cables.

Each cell 311 is formed in a manner substantially as described in copending application Ser. No. 900,909, filed Aug. 28, 1986 and entitled "Integrally Molded Cable Termination Assembly, Contact and Method," now U.S. Pat. No. 4,767,352 dated Aug. 30, 1988, which application is hereby incorporated herein by reference. Although reference may be had to said copending application for a more complete and detailed description of the cell configuration and function, the following concise description will be provided for completeness of the present disclosure.

With particular reference to FIGS. 38 and 47–50, each cell 311 includes both a contacting area 315, a positioning area 316 and a land support 317. The contacting area 315 is where a pin contact may be inserted to engage a contacting portion of the electrical contact. The positioning area 316 helps properly to position the contact in the cell for both during manufacture of the cable termination assembly and during subsequent use of the cable termination assembly. The land support 317 provides a contact support function described in greater detail below.

The contacting area 315 of each cell 311 is of generally square cross-sectional shape for accommodating a pair contact of either square or circular cross-section shape. The width of the positioning area 316 is about the same as the width of the contacting area, but the thickness of the positioning area is smaller than the thickness of the contacting area so as to provide a relatively close fit for part of the contact to accomplish a desired positioning function, as will be described further below.

Each cell 311 at its rearward end has a relatively large rectangular opening 320. The land 317 slopes to provide a gradual lead-in from the wide area of such opening 320 to the narrower positioning area. The land 317 is the start of a rib that extends to a land 321 adjacent the exterior opening 310 of each cell.

At the rear end of the end cap 223, a pair of lips 323 extend along the side edges of the cap and project rearwardly from the rear surface 324 of the cap. Preferably the inner sides 325 of the lips 323 are undercut to provide a mechanical interlock with the strain relief body 224 molded to the rear end of the cap as seen in FIG. 38.

The end cap 223 also includes a pair of holes 328 and 329 for receiving respective tabs 290 and 291 of the management comb 222. The holes extend longitudinally and open to the rear end face 324 of the end cap. As shown, the slots may have a generally rectangular cross-sectional shape with the shorter sides thereof having sloped for guiding insertion of the tabs of the conductor-contact management comb into the holes.

As will be appreciated, the end cap 223 provides a number of functions. The cap houses the forward portion of each of the contacts, provides a positioning function cooperating with the contacts to insure proper positioning thereof both for purposes of manufacturing the cable termination assembly and for use thereof, provides guidance for external members, such as pin contacts which are inserted into the cells, and cooperates with the contacts to avoid over stressing of the contacts.

Figure 51:
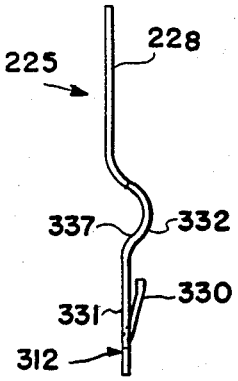
FIG. 51 is an edge view of a contact used in the modified cable termination assembly of FIG. 29.
Figure 52:
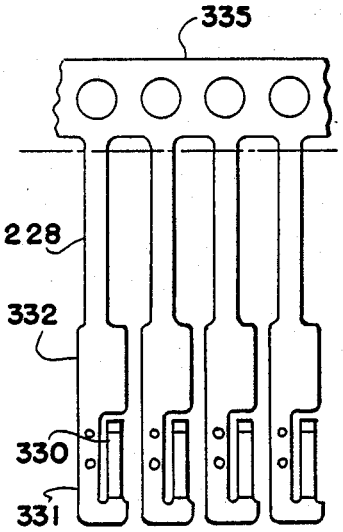
FIG. 52 is a plan view of the contact of FIG. 51 prior to separation from a carrier strip for plural contacts.

As seen in FIGS. 51 and 52, the forward portion 312 of each contact 225 is generally of U-shape with one leg 330 being bent out of the plane of the other leg 331 to form a contacting or wiping arm. The other or support leg 331 is attached at its rearward end to a base portion 332 from which the tail 228 extends rearwardly. The tail portion 228, which has a width less than that of the base portion 332, is offset laterally with respect to the wiping arm.

The contacts 225 may be die cut from a strip of material, and such contacts may be carried by a carrier strip 335 at the rearward ends of the contact tails 228 in a manner that is well known. The carrier strip facilitates handling and manipulation of a row of the contacts such as for simultaneous insertion of the contacts into respective cells 311 in one row thereof provided in the end cap 223. The carrier strip may be separated from the contact tails as by shearing. In similar manner, the contacts may be inserted into the other row of cells in the end cap but with the contacts reversely oriented.

Figure 47:
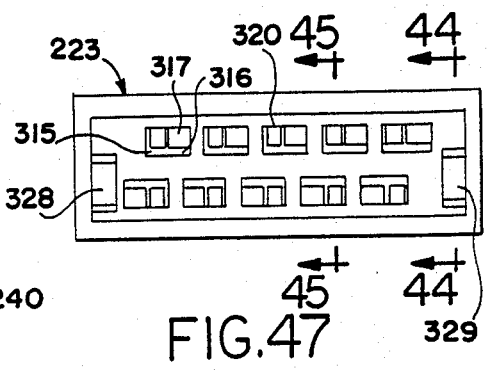
FIG. 47 is a rear end view of the end cap used in the modified cable termination assembly of FIG. 29.
Figure 48:
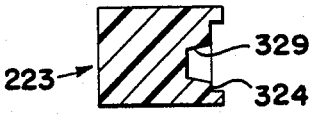
FIG. 48 is a sectional view of the end cap of FIG. 47 taken along the line 48—48 of FIG. 47.
Figure 49:
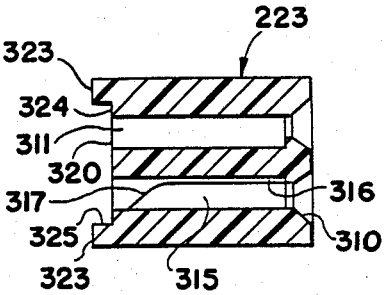
FIG. 49 is a sectional view of the end cap of FIG. 47 taken along the line 49—49 of FIG. 47.
Figure 50:
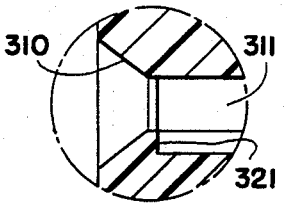
FIG. 50 is an enlarged portion of FIG. 49.

Further with regard to insertion of the contacts 225 into the end cap 323 and with particular reference to Figs. 38, 47 and 50, initially each contact is aligned with the opening 320 at the back of the cell such that the support leg is aligned to slide into the positioning area 316 and the wiping arm 330 is aligned to slide into contacting area 315 of the cell. Further insertion of the contact into a cell will place the front side of a front or shut-off wall 337 of the bowed base portion 332 in confronting engagement with the sloped support land 317. The shape of the support land preferably is configured to fit relatively closely in engagement with the obtusely angled shut-off wall 337 of the bowed base portion for desired accurate positioning of the contacts in the end cap. Also, the shut-off wall 337 of the bowed base portion fits closely in the opening 320 at the back of the cell. That is, the shut-off wall substantially completely fills the opening of the cell with only a small amount of clearance between the edges of the shut-off wall and the side walls of the opening which is sufficiently small to prevent flow of the molding material beyond the shut-off wall. That is, the flow of plastic will be blocked by the shut-off wall and thereby prevent it from flowing into the forward portion of the cell containing the wiping arm and where such flow of material could interfere with proper operation of the wiping arm.

At its leading end attached to the base portion, the tail 228 of each contact is bent to form a continuation of the bow and to locate the contact tail proper in a plane offset from the support arm in a direction opposite the direction of the bow in the base portion 332. In relation to the end cap 223, the base portion and leading part of the contact tail are configured to locate the tails of the contacts in one row coplanar with the tails of the contacts in the other row, i.e., in a plane bisecting the two rows of cells in the end cap. Also, because of the offset of the contact tail relative to the wiping arm, the tails of the contacts in each row are laterally spaced from and alternate with the tails of the contacts in the other row as seen in FIG. 36.

When assembled together as above described, the cables 201, drain bus 226, ground bus 227, contacts 225, end cap 223 and conductor-contact management comb 222 together form a subassembly that is placed in a mold (if not directly assembled therein or in a part of the mold) to overmold the balance forming, strain relief body 224 of the housing 203. After such loading of the components in the mold, the mold is closed and the balance 224 of the housing 202 is molded, as by injection molding, to such components to form a unified structure therewith. The molded strain relief body 224 preferably encapsulates the electrical junctions between the conductors and contacts, those between the conductors and the ground bus, and those between the contacts and the ground bus. The mold also preferably includes mold cores and/or locating elements for forming cored out areas in the balance forming part of the housing and/or for locating and holding the components in proper position in the mold. Cored out areas may be provided to reduce material requirements and to avoid thick plastic sections that may be subject to sinking during cooling of the molding material. The rear body section 233 of the management comb may engage and thereby be held between the mold halves.

After molding of the balance forming part 224, the shield plates 204 and 205 are attached to opposite sides of the housing 203 by the rivets 206 as above-described. Then, the ends of the drain bus 226, which then would be projecting from the sides of the molded strain relief body (as seen in FIGS. 33 and 34), are bent around and over onto one of the shield plates for soldering thereto as seen in FIGS. 29 and 30. If desired, one end of the ground bus may be soldered to one shield plate and the other end soldered to the other shield plate. It will be appreciated that preferably the drain wires, drain bus and shield plates are electrically connected in common.

Although the invention has been described with respect to several preferred embodiments, the present invention includes all equivalents and is limited only by the scope of the following claims.

We claim:

1. A cable termination assembly electrical cable means including plural wire conductors; plural electrical contact members having forward contacting portions and rearward coplanar tail portions, at least one of said coplanar tail portions having attached thereto a respective one of said conductors; an electrical bus located generally rearwardly of said coplanar tail portions of said contact members, the tail portions of at least two of said contact members being attached to said electrical bus and said electrical bus being spaced from the tail portion of at least one other of said contact members to which one of said conductors is attached; and housing means for holding said conductors, contact members and electrical bus with respect to one another.

2. An assembly as set forth in claim 1, wherein said electrical bus is rearwardly spaced from the tail portion of said one other of said contact members, and said tail portions of said two of said contact members extend rearwardly beyond said tail portion of said one other of said contact members for attachment to said electrical bus.

3. An assembly as set forth in claim 2, wherein said tail portions are generally coplanar and laterally spaced apart, and said electrical bus includes a laterally extending electrically conductive bus strip offset to one side of the plane of said tail portions.

4. An assembly as set forth in claim 1, wherein at least one of said conductors is attached to said electrical bus.

5. An assembly as set forth in claim 1, wherein said housing means includes management means, said management means including means for positioning some of said conductors in laterally spaced apart, generally parallel relationship for attachment to the tail portions of some of said contact members, and laterally extending slot means for accommodating said electrical bus.

6. A cable termination assembly comprising electrical cable means including plural electrical conductors, plural electrical contact members having forward contacting portions and rearward tail portions, conductor-contact management means for positioning said conductors and contact members with respect to one another, and housing means for holding said conductors, contact members and management means with respect to one another, said management means including on one side thereof a row of conductor positioning slot means to receive and position a plurality of said conductors in laterally spaced apart relationship and on an opposite side thereof a row of contact positioning slot means to receive, position and align said tail portions of said contact members with respective ones of said conductors, and said management means further including opening means mutually adjacent said conductor positioning slot means and said contact positioning slot means for permitting attachment of said conductors on said one side of said management means to said tail portions on the opposite side of said management means.

7. An assembly as set forth in claim 6, wherein said conductor positioning slot means includes a first row of slots located forwardly of said opening means and a second row of slots located rearwardly of said opening means, said plurality of conductors each having longitudinally spaced apart portions positioned in respective slots of said first and second rows and an intermediate portion coextensive with said opening means and attached to the tail portion of a respective one of said contact members.

8. An assembly as set forth in claim 7, wherein said tail portions of said contact members extend beneath said opening means and said intermediate portions of said conductors extend downwardly with respect to said spaced apart portions for attachment to said tail portions.

9. A conductor management comb for use in a cable termination assembly, comprising a pair of generally parallel, longitudinally extending side walls, and four generally parallel and generally coplanar body sections extending laterally between said side walls and each including a row of slot means for locating respective portions of longitudinally extending conductors, said body sections being spaced apart longitudinally to form respective through openings between relatively adjacent pairs of said body sections.

10. A cable termination assembly comprising a housing having a generally rectangular rear end face having two opposed shorter sides and two opposed longer sides, a plurality of cables exiting rearwardly from said housing in a row parallel to said longer sides of said end face, a first pair of opposed curved surface means extending along said shorter sides of said end face, respectively, for defining a minimum bending radius for said cables when flexed in a direction parallel to said longer sides, and a second pair of opposed curved surface means extending along said longer sides of said end face, respectively, for defining a minimum bending radius for said cables when flexed in a direction parallel to said shorter sides and for maintaining said cables between said curved surface means of said first pair.

11. An assembly as set forth in claim 10, comprising shield means attached to and at least partly surrounding said housing, and wherein said shield means includes generally planar and parallel shield portions at opposed sides of said housing, said shield portions include bent rear end portions which extend rearwardly beyond said end face of said housing at said longer sides of said end face, and said bent rear end portions include said curved surface means of said second pair.

12. A cable termination assembly comprising conductor management means including first and second body sections each including at least one conductor slot opening to a top side of said housing, said first and second body sections being longitudinally spaced apart to form therebetween a through opening, at least one conductive member coextensive with said through opening and located generally beneath said one slot of each body section, and at least one conductor having a first portion received in said one slot of said first body section, a second portion received in said one slot of said second body portion, and a connection portion between said first and second portions which extends downwardly through said through opening and is attached to said conductive member.

13. An assembly as set forth in claim 12, wherein said connection portion is welded to said conductive member.

14. A cable termination assembly comprising electrical cable means including plural electrical conductors, plural electrical contact members having forward contacting portions and rearward tail portions, conductor-contact management means for positioning said conductors and contact members with respect to one another, and housing means for holding said conductors, contact members and management means with respect to one another, said management means including on one side thereof a row of conductor positioning slot means to receive and position a plurality of said conductors in laterally spaced apart relationship and on an opposite side thereof a row of contact positioning slot means to receive, position and align said tail portions of aid contact members with respective ones of said conductors, said management means further including opening means mutually adjacent said conductor positioning slot means and said contact positioning slot means for permitting attachment of said conductors on said one side of said management means to said tail portions on the opposite side of said management means, said conductor positioning slot means including a first row of slots located forwardly of said opening means and a second row of slots located rearwardly of said opening means, said plurality of conductors each having longitudinally spaced apart portions positioned in respective slots of said first and second rows and an intermediate portion coextensive with said opening means and attached to the tail portions of a respective one of said contact members, said tail portions of said contact members extending beneath said opening means and said intermediate portions of said conductors extending downwardly with respect to said spaced apart portions for attachment to said tail portions, and said management means further including laterally spaced apart divider wall means in said opening means for dividing said opening means into plural opening respectively aligned with said contact positioning slot means for maintaining said intermediate portions of said conductors laterally spaced apart.

15. A cable termination assembly comprising a housing having a generally rectangular rear end face having two opposed shorter sides and two opposed longer sides; a plurality of cables exiting rearwardly from said housing in a row, which row is parallel to said longer sides of said end face; and shield means attached to and at least partly surrounding said housing; said shield means including generally planar and parallel shield portions at opposite sides of said housing, said shield portions including bent rear end portions which extend rearwardly beyond said end face of aid housing at said longer sides of said end face, said housing including a pair of extensions extending rearwardly from said end face of aid housing at said shorter sides of said end face, said extensions including a first pair of opposed curved surface means extending along said shorter sides of said end face, respectively, for defining a minimum bending radius for said cables when flexed in a direction parallel to said longer sides, and said end portions including a second pair of opposed curved surface means extending along said longer sides of said end face, respectively, for defining a minimum bending radius for said cables when flexed in a direction parallel to said shorter sides and for maintaining said cables between said curved surface means of said first pair.

* * * * *

UNITED STATES PATENT AND TRADEMARK OFFICE

CERTIFICATE OF CORRECTION

PATENT NO. : 4,985,000

DATED : January 15, 1991

INVENTOR(S) : John N. Tengler and Roy A. Gobets

It is certified that error appears in the above-identified patent and that said Letters Patent is hereby corrected as shown below:

Column 24, line 31, --comprising-- should be inserted after "assembly".

Column 26, line 34 "aid" should read --said--.

Column 26, line 49, "portions" should read --portion--.

Column 26, line 57, "opening" (2nd occurance) should read --openings--.

Column 27, lines 3 and 6, "aid" should read --said--.

Signed and Sealed this

Nineteenth Day of May, 1992

*Attest:*

DOUGLAS B. COMER

*Attesting Officer*

*Acting Commissioner of Patents and Trademarks*